US007831173B2

(12) United States Patent
Kusukawa et al.

(10) Patent No.: US 7,831,173 B2
(45) Date of Patent: Nov. 9, 2010

(54) IMAGE FORMING APPARATUS AND IMAGE BEARING MEMBER COVER

(75) Inventors: Takashi Kusukawa, Osaka (JP); Kiyonori Yamamoto, Osaka (JP)

(73) Assignee: Kyocera Mita Corporation (JP)

( * ) Notice: Subject to any disclaimer, the term of this patent is extended or adjusted under 35 U.S.C. 154(b) by 279 days.

(21) Appl. No.: 12/051,414

(22) Filed: Mar. 19, 2008

(65) Prior Publication Data

US 2008/0232847 A1 Sep. 25, 2008

(30) Foreign Application Priority Data

Mar. 23, 2007 (JP) ..... 2007-077302
Apr. 10, 2007 (JP) ..... 2007-102802
Jun. 12, 2007 (JP) ..... 2007-155398

(51) Int. Cl.
*G03G 15/00* (2006.01)

(52) U.S. Cl. ..... 399/114; 399/107; 399/110; 399/124

(58) Field of Classification Search ..... 399/107, 399/110, 111, 114, 116, 117, 119, 124
See application file for complete search history.

(56) References Cited

U.S. PATENT DOCUMENTS 4,588,280 A * 5/1986 Ogawa et al. ..... 399/114
5,162,846 A * 11/1992 Cahill ..... 399/125
2006/0171740 A1* 8/2006 Ogawa ..... 399/124

FOREIGN PATENT DOCUMENTS

JP 6-236080 8/1994
JP 2005-91482 4/2005

* cited by examiner

*Primary Examiner*—David P Porta
*Assistant Examiner*—Casey Bryant
(74) *Attorney, Agent, or Firm*—Gerald E. Hespos; Michael J. Porco

(57) ABSTRACT

An image forming apparatus has an image bearing member and a main body with an internal conveyance path for conveying a transfer material. An opening/closing member is attached to the main body and is displaceable between a closed position and an opened position where the conveyance path is exposed. A cover is set to cover a part of the image bearing member facing the conveyance path when the opening/closing member is open and is retracted from the conveyance path when the opening/closing member is closed. A moving mechanism slides the cover. Front and rear frames are held movably by the moving mechanism and are attached respectively to front and rear edges of the cover in a sliding direction. A tension applying mechanism acts on the frames to apply tension to the cover in the sliding direction during a sliding movement of the cover.

16 Claims, 16 Drawing Sheets

IMAGE FORMING APPARATUS AND IMAGE BEARING MEMBER COVER

BACKGROUND OF THE INVENTION

1. Field of the Invention

The present invention relates to an image forming apparatus provided with a cover capable of covering an image bearing member.

2. Description of the Related Art

There is known an image forming apparatus in which a vertical conveyance path for vertically conveying a transfer sheet is provided behind an opening/closing cover provided on an apparatus main body having a housing structure and a photoconductive drum is disposed at a back side facing the conveyance path. The opening/closing cover is so provided as to communicate the interior of the apparatus main body with the outside to deal with a jam of a transfer sheet in the conveyance path and other maintenance operations. Thus, if the opening/closing cover is opened, the conveyance path and various parts facing the conveyance path are exposed through an opening. For example, in the case of dealing with a sheet jam, an operator can insert his or her hand into the apparatus through the opening to easily remove the jammed transfer sheet by opening the opening/closing cover.

However, if the hand or other things touch the outer surface of the photoconductive drum during such an operation, it might cause an image formation defect due to the distortion or damage of the drum surface. Accordingly, it has been known to provide a drum cover for covering an exposed part (part facing the conveyance path) of the photoconductive drum when the opening/closing cover is at an opening position. This drum cover is retracted from the conveyance path so as not to hinder the conveyance of transfer sheets when the opening/closing cover is at a closing position.

For example, an image forming apparatus disclosed in Japanese Unexamined Patent Publication No. H06-236080 is constructed such that a rectangular drum cover P22, in which a sheet member P21 stretches on a rectangular frame P20, is so arranged above a photoconductive drum P3 as to be pivotal about a rotation axis center X1 in parallel with an axial center X of the photoconductive drum as shown in FIG. 17. The drum cover P22 pivots between positions (A) and (B) in FIG. 17 while being linked with the opening and closing of an unillustrated opening/closing cover, thereby being switched between a protecting state where the drum cover P22 protects the photoconductive drum P3 and a retracted state where the conveyance of transfer sheets is not hindered.

For example, an image forming apparatus disclosed in Japanese Unexamined Patent Publication No. 2005-91482 is constructed such that a strap P24 having one end thereof connected with an opening/closing cover and the other end thereof connected with a take-up roller P23 that dispenses and takes up the strap P24 while a biasing force is acting is provided at each of the opposite ends of a photoconductive drum P3 as shown in FIG. 18. A drum cover P26 is mounted at parts of the two straps P24 corresponding to the photoconductive drum 3 such that a flexible sheet member P25 spans between the two straps P24. The drum cover P26 is slid between positions (C) and (D) in FIG. 18 while being linked with the opening and closing of an unillustrated opening/closing cover, thereby being switched to the protecting state and the retracted state.

However, in the apparatus of Japanese Unexamined Patent Publication No. H06-236080, the drum cover P22 itself is disposed at the fixed position above the photoconductive drum P3 and needs to pivot about the rotation axis center X1 upon switching the state of the drum cover P22 between the protecting state and the retracted state. Since other members cannot be arranged in a wide range of this pivotal movement, it is necessary to leave this range as an empty space, which leads to restrictions in the arrangements of the respective mechanisms in the image forming apparatus. Since an extra space needs to be provided in the apparatus, there is another problem of enlarging the image forming apparatus.

Further, since the straps P24 and the drum cover P26 are both flexible according to the apparatus of Japanese Unexamined Patent Publication No. 2005-91482, a sliding movement can be made along a bent path and a movement path for the drum cover P26 can be set even in a small clearance in the image forming apparatus. However, if an operator's hand or the like touches the drum cover P26 in the protecting state, for example, upon dealing with a sheet jam, there is a problem of being likely to reduce a protection function due to the easy flexibility of the drum cover P26. In order to prevent this, the drum cover P26 needs to be spaced apart from the outer surface of the photoconductive drum P3 by a substantial distance. In any case, there are many restrictions in setting the movement path for the drum cover P26, leading to a problem of making it difficult to downsize the image forming apparatus.

SUMMARY OF THE INVENTION

An object of the present invention is to provide an image forming apparatus which can be easily downsized while ensuring a sufficient protection function for an image bearing member.

In order to accomplish this object, one aspect of the present invention is directed to an image forming apparatus, comprising an apparatus main body having a housing structure; a conveyance path provided in the apparatus main body for conveying a transfer material, to which an image is to be transferred; an opening/closing member attached to the apparatus main body and displaceable between a closed position and an opened position where the conveyance path is exposed; an image bearing member arranged in the apparatus main body to face the conveyance path and adapted to bear the image to be transferred to the transfer material; an image bearing member cover having such a size as to cover the image bearing member, made of a flexible sheet material, set in a protecting state to cover a part of the image bearing member facing the conveyance path when the opening/closing member is at the opened position and set in a retracted state to be retracted from the conveyance path when the opening/closing member is at the closed position; a cover moving mechanism for sliding the image bearing member cover between the protecting state and the retracted state; a front frame and a rear frame movably held by the cover moving mechanism and respectively attached to front and rear edge portions of the image bearing member cover in a sliding direction; and a tension applying mechanism for applying a tension acting in the sliding direction to the image bearing member cover via the front and rear frames during a sliding movement of the image bearing member cover.

These and other objects, features, aspects and advantages of the present invention will become more apparent upon a reading of the following detailed description and accompanying drawings.

DETAILED DESCRIPTION OF THE PREFERRED EMBODIMENTS

First Embodiment

Figure 1:
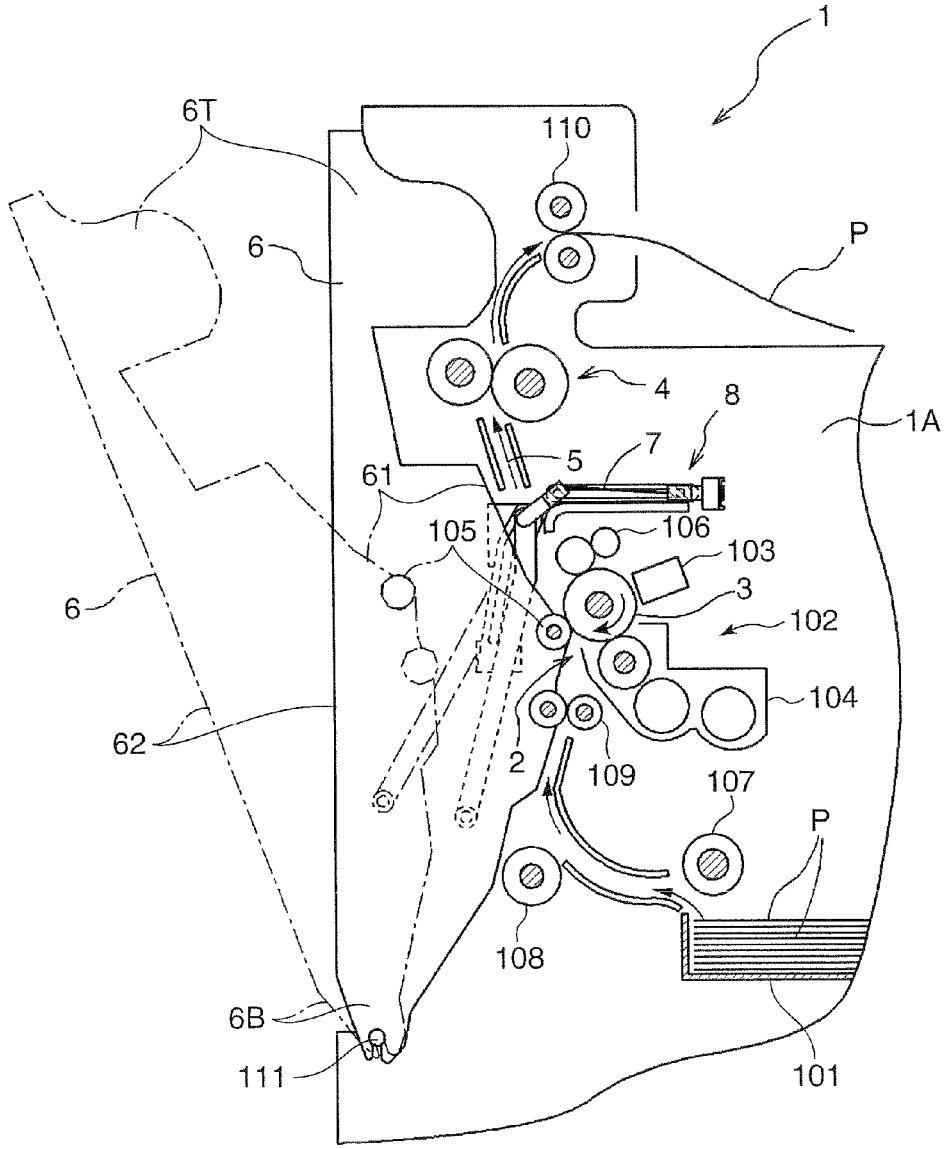
FIG. 1 is a section showing an essential portion of an image forming apparatus according to a first embodiment of the invention.
Figure 2:
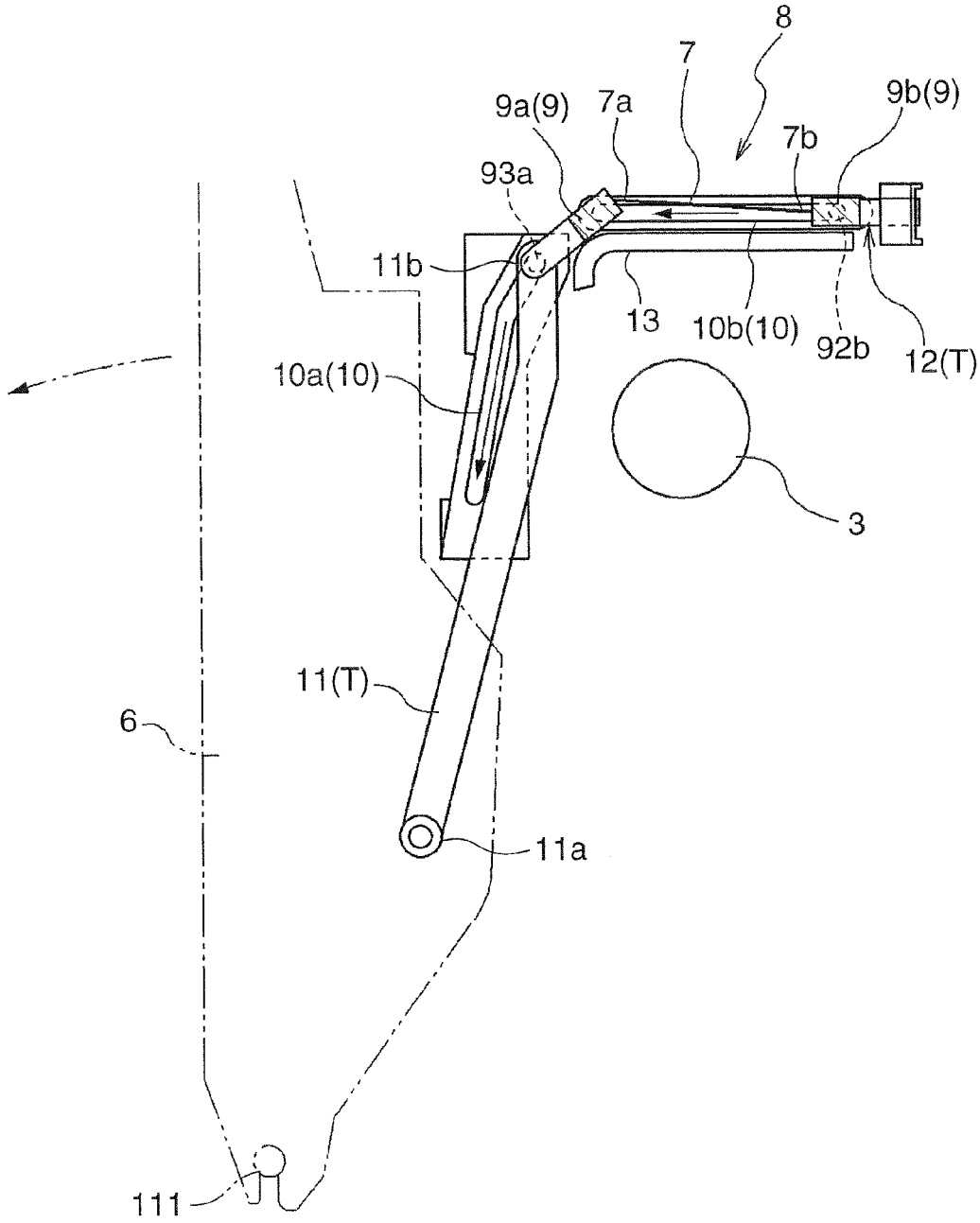
FIG. 2 is a diagram showing the function of a drum cover according to the first embodiment when viewed in a direction of the axial center of a photoconductive drum.

FIG. 1 is an essential section showing an image forming apparatus 1 according to one embodiment of the present invention. The image forming apparatus 1 is, for example, a copier, a facsimile machine or a printer.

The image forming apparatus 1 is provided, in an apparatus main body 1A having a housing structure, with a sheet storage unit 101 consisting of a sheet cassette or a sheet feed tray for storing a multitude of transfer sheets (transfer materials), an image forming assembly 102 for forming a toner image and transferring the toner image to a transfer sheet P, a fixing device 4 for fixing the toner image to the transfer sheet P, and a conveyance path 5 for conveying the transfer sheet P from the sheet storage unit 101 to a discharge tray via the image forming assembly 102 and the fixing device 4.

The image forming assembly 102 includes a photoconductive drum 3 (image bearing member) rotatable in a clockwise direction as shown by an arrow in FIG. 1, and a charger 103, an exposure device (not shown), a developing device 104, a transfer roller 105 and a cleaning device 106 arranged around the photoconductive drum 3.

The photoconductive drum 3 is a drum made of, e.g. amorphous silicon and bears an electrostatic latent image and a toner image (image to be transferred to a transfer sheet P) on the outer circumferential surface thereof. The charger 103 uniformly charges the outer circumferential surface of the photoconductive drum 3. The exposure device irradiates the outer circumferential surface of the photoconductive drum 3 with a laser beam corresponding to an image data to form an electrostatic latent image. The developing device 104 develops the electrostatic latent image by supplying toner to the photoconductive drum 3, whereby a toner image is formed. The transfer roller 105 is arranged to form a nip portion between the transfer roller 105 and the photoconductive drum 3 and generates a transfer bias to transfer the toner image to the transfer sheet P. Accordingly, this nip portion serves as an image transfer device 2. The cleaning device 106 removes the toner residual on the outer circumferential surface of the photoconductive drum 3 after the transfer of the toner image.

A sheet P stored in the sheet storage unit 101 is dispensed one by one by a pickup roller 107 and fed to the transfer device 2 at a specified timing by registration rollers 109 after being conveyed to the registration rollers 109 via an intermediate roller 108. In the transfer device 2, the transfer sheet P has a toner image formed on the photoconductive drum 3 transferred thereto and is then conveyed to the fixing device 4 to be heated and pressed, whereby the toner image is fixed. Thereafter, the transfer sheet P is discharged to the outside of the apparatus main body 1A by discharge rollers 110.

In this embodiment, the transfer device 2, the fixing device 4 and the discharge rollers 110 are successively arranged above the sheet storage unit 101 in the apparatus main body 1A. Thus, the conveyance path 5 for the transfer sheets P is a so-called "vertical" conveyance path extending in vertical direction.

An opening/closing cover 6 (opening/closing member) is mounted on a side wall portion of the housing (covering) of the apparatus main body 1A near the conveyance path 5. The opening/closing cover 6 is opened (opened position: shown in dashed-dotted line in FIG. 1), for example, upon a jam processing, maintenance, inspection or the like and is normally closed (closed position: shown in solid line in FIG. 1).

The opening/closing cover 6 is so supported at its bottom end 6B as to be pivotal about a supporting member 111 provided in the apparatus main body 1A. When being at the opened position, the opening/closing cover 6 pivots with the supporting member 111 as a supporting point of pivotal movement, and an upper end 6T thereof is moved in a direction away from the apparatus main body 1A. An inner side surface 61 of the opening/closing cover 6 serves as one wall surface defining the conveyance path 5 with the opening/closing cover 6 held at the closed position. On the other hand, an outer side surface 62 of the opening/closing cover 6 constitutes a part of the housing of the apparatus main body 1A with the opening/closing cover 6 held at the closed position. Therefore, the conveyance path 5 is exposed if the opening/closing cover 6 is at the opened position.

The transfer roller 105 is rotatably held near the inner side surface 61 of the opening/closing cover 6. The photoconductive drum 3 is so arranged as to face the transfer roller 105 in the apparatus main body 1A, i.e. to face the conveyance path 5. Thus, if the opening/closing cover 6 is set at the opened position, a part of the photoconductive drum 3 facing the conveyance path 5 is exposed in the case of providing no drum cover 7 (image bearing member cover) to be described later.

If the part of the photoconductive drum 3 is exposed to the outside, there is a risk that an operator's hand or accessory, a tool or the like touches the photoconductive drum 3 to damage the photoconductive drum 3 or external light is directly incident on the photoconductive drum 3 to deteriorate the photoconductive drum 3. Accordingly, the image forming apparatus 1 of this embodiment is provided with the drum cover 7 and a cover moving mechanism 8 for sliding the drum cover 7 along the outer surface of the photoconductive drum 3.

Figure 3:
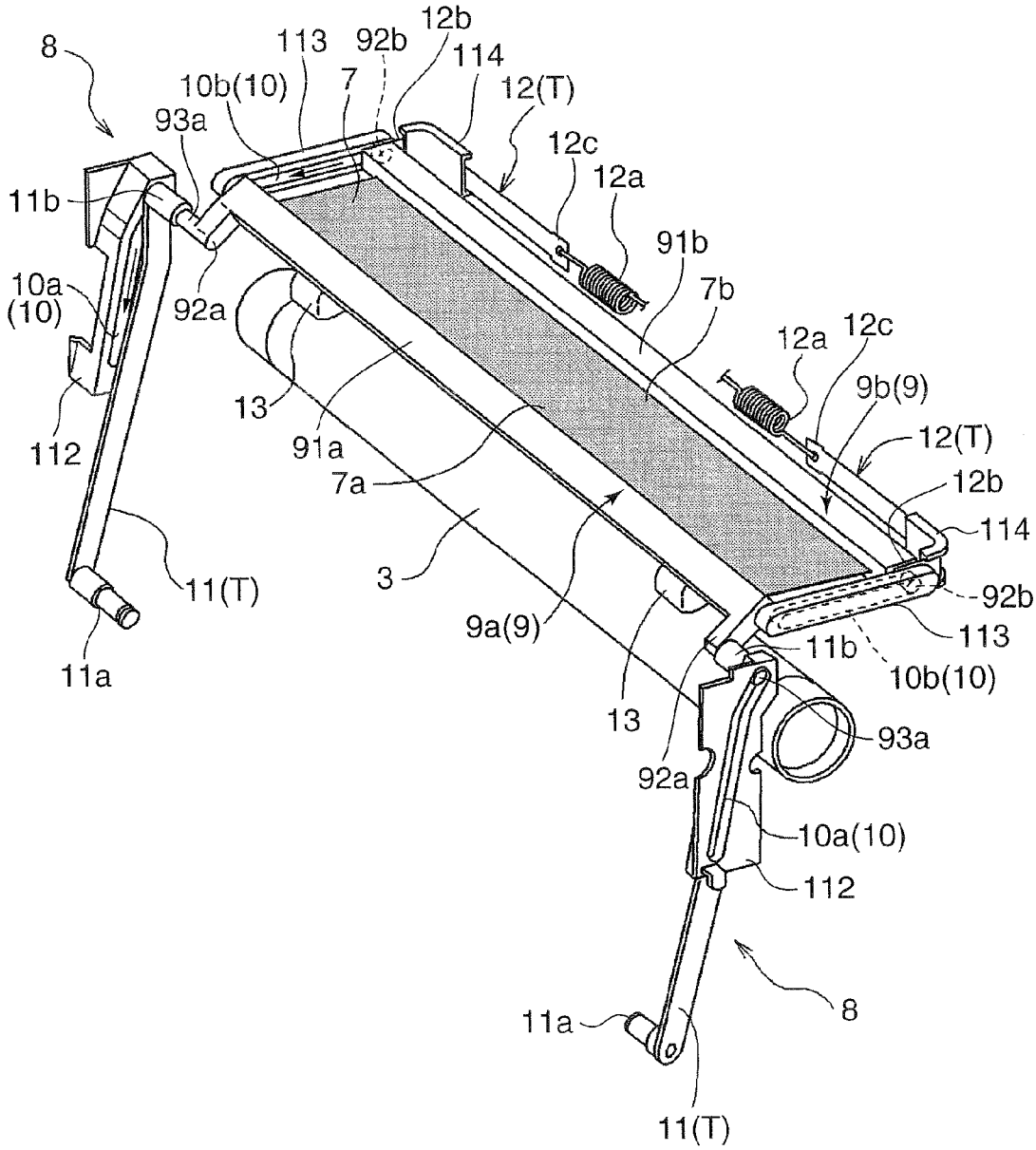
FIG. 3 is an essential perspective view showing the function of the drum cover.
Figure 4:
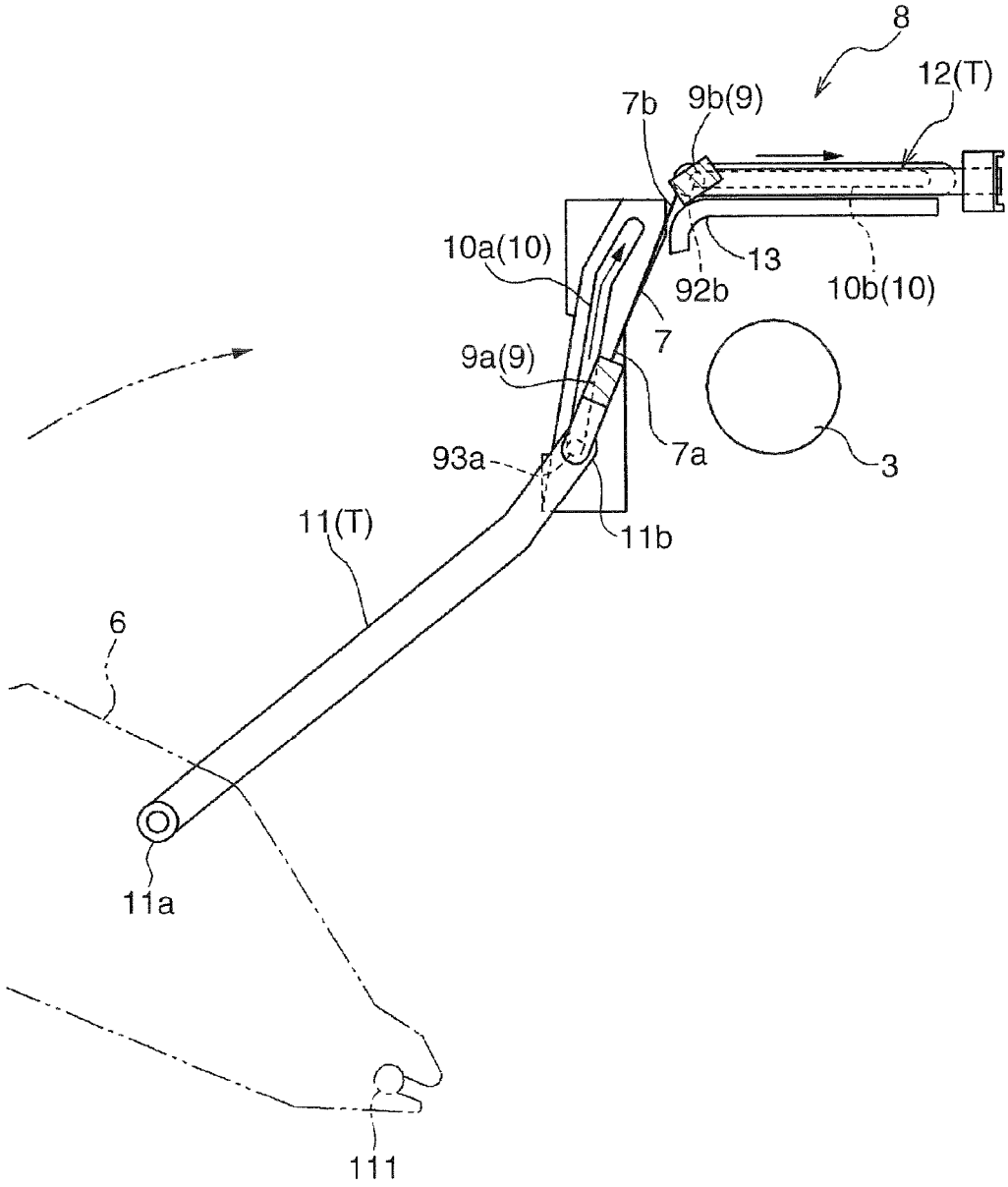
FIG. 4 is a diagram showing the function of the drum cover when viewed in the direction of the axial center of the photoconductive drum.

The drum cover 7 is slid toward the conveyance path 5 as the opening/closing cover 6 is opened, thereby covering the part of the photoconductive drum 3 facing the conveyance path 5 to be set in a protecting state to protect the photoconductive drum 3 (see FIG. 5), whereas the drum cover 7 is set in a retracted state to be retracted from the conveyance path 5 as the opening/closing cover 6 is closed (see FIG. 3). The cover moving mechanism 8 is a mechanism for sliding the drum cover 7 along the circumferential surface of the photoconductive drum 3 between the protecting state and the retracted state as the opening/closing cover 6 is opened and closed. The drum cover 7 and the cover moving mechanism 8 are described with reference to FIGS. 2 to 5 below.

The drum cover 7 is formed of a flexible rectangular sheet member made of high molecular weight polyethylene. The width of the drum cover 7 (dimension in a direction along a rotational axis direction of the photoconductive drum 3) is substantially equal to (or slightly longer than) the length of the photoconductive drum 3, and the length thereof is about twice the outer diameter of the photoconductive drum 3.

Frames 9 are attached to a front edge portion 7*a* and a rear edge portion 7*b* of the drum cover 7 in a sliding direction between the retracted state and the protecting state, so that these edge portions can be held over the entire widths. The frames 9 includes a front frame 9*a* attached to the front edge portion 7*a* and a rear frame 9*b* attached to the rear edge portion 7*b*.

As shown in FIG. 3, the front frame 9*a* includes a first holding portion 91*a* for holding the front edge portion 7*a* of the drum cover 7 by sandwiching it, projecting pieces 92*a* projecting in the sliding direction from the opposite sides of the first holding portion 91*a* and first engaging portions 93*a* projecting outward in the axial direction of the photoconductive drum 3 from the leading ends of the respective projecting pieces 92*a*. The rear frame 9*b* includes a second holding portion 91*b* for holding the rear edge portion 7*b* of the drum cover 7 by sandwiching it and second engaging portions 92*b* projecting outward in the axial direction of the photoconductive drum 3 from the opposite ends of the second holding portion 91*b*.

The leading ends of the first and second engaging portions 93*a*, 92*b* are supported by being respectively fitted into slide guide grooves 10 (cover moving mechanism) separately formed in fixing frames 112, 113 of the apparatus main body 1A located at the opposite ends of the photoconductive drum 3. The first engaging portions 93*a* and the second engaging portions 92*b* are slidable along the longitudinal directions of the slide guide grooves 10.

The slide guide grooves 10 include two types of groove; those with a vertical sliding direction and those with a horizontal sliding direction. In other words, in a view seen in a direction of the axial center of the photoconductive drum 3, there are vertical slide guide grooves 10*a* (first guide portions) vertically extending before (toward the conveyance path) the photoconductive drum 3 and horizontal slide guide grooves 10*b* (second guide portions) horizontally extending above the photoconductive drum 3.

The leading ends of the first engaging portions 93*a* projecting from the opposite ends of the front frame 9*a* are fitted into the vertical slide guide grooves 10*a*. The leading ends of the second engaging portions 92*b* projecting from the opposite ends of the rear frame 9*b* are fitted into the horizontal slide guide grooves 10*b*.

The image forming apparatus 1 of this embodiment is provided with a tension applying mechanism T for applying a tension acting in the sliding direction to the drum cover 7 via the front frame 9*a* and the rear frame 9*b* during a sliding movement of the drum cover 7. The tension applying mechanism T in this embodiment includes a pair of link arms 11 (first arm members) attached to the opposite ends of the front frame 9*a* and a pair of spring strip members 12 (second arm members) attached to the opposite ends of the rear frame 9*b*.

As described above, the opening/closing cover 6 is pivotally supported by the supporting member 111 and is displaced between the opened position and the closed position by pivoting about the supporting member 111. A first end 11*a* (one end) of each link arm 11 is rotatably attached at a position near the inner side surface 61 of the opening/closing cover 61. A second end 11*b* (other end) of each link arm 11 is rotatably engaged with the first engaging portion 93*a* while being held between the fixing frame 112 and the projecting piece 92*a* of the front frame 9*a*.

The opening/closing cover 6 and the front frame 9*a* can be linked by the presence of this pair of link arms 11. When the opening/closing cover 6 is at the closed position, the front frame 9*a* is located at the upper ends of the vertical slide guide grooves 10*a* (see FIG. 2). On the other hand, when the opening/closing cover 6 is at the opened position, the first engaging portions 93*a* are pulled by the link arms 11 to locate the front frame 9*a* at the bottom ends of the vertical slide guide grooves 10*a* (see FIG. 4).

The strip members 12 having springs 12*a* built therein are attached to the rear frame 9*b*. A first end 12*b* (one end) of each strip member 12 is engaged with the second engaging portion 92*b* of the rear frame 9*b* and retained by the fixing frame 113. One end of the spring 12*a* is attached to a second end 12*c* (other end) of each strip member 12. The other end of the spring 12*a* is attached to a specified fixing portion (not shown) of the apparatus main body 1A.

The strip member 12 is a flexible member made of a polyester (PET) resin film and stretches via the fixing frame 114 of the apparatus main body 1A, whereby a stretching direction thereof is bent inward at 90°. By the respective springs 12*a*, the both strip members 12 are biased in directions toward each other.

By the spring function of the strip members 12, a tensile force acts to pull the rear frame 9*b* backward (toward a side opposite to the front frame 9*a*). This tensile force acts on the drum cover 7 having the front end side thereof attached to the opening/closing cover 6 via the front frame 9*a* and the link arms 11. Therefore, the drum cover 7 can be constantly held so as not to be slackened.

If the opening/closing cover 6 is opened to the opened position, the first engaging portions 93*a* of the front frame 9*a* are pulled by the link arms 11 and move toward the bottom ends of the vertical slide guide grooves 10*a*. According to this movement of the front frame 9*a*, the drum cover 7 is pulled to make such a sliding movement as to cover the exposed part of the photoconductive drum 3. The rear frame 9*b* also moves forward while the second engaging portions 92*b* are guided by the horizontal slide guide grooves 10*b* as the drum cover 7 is slid.

Figure 5:
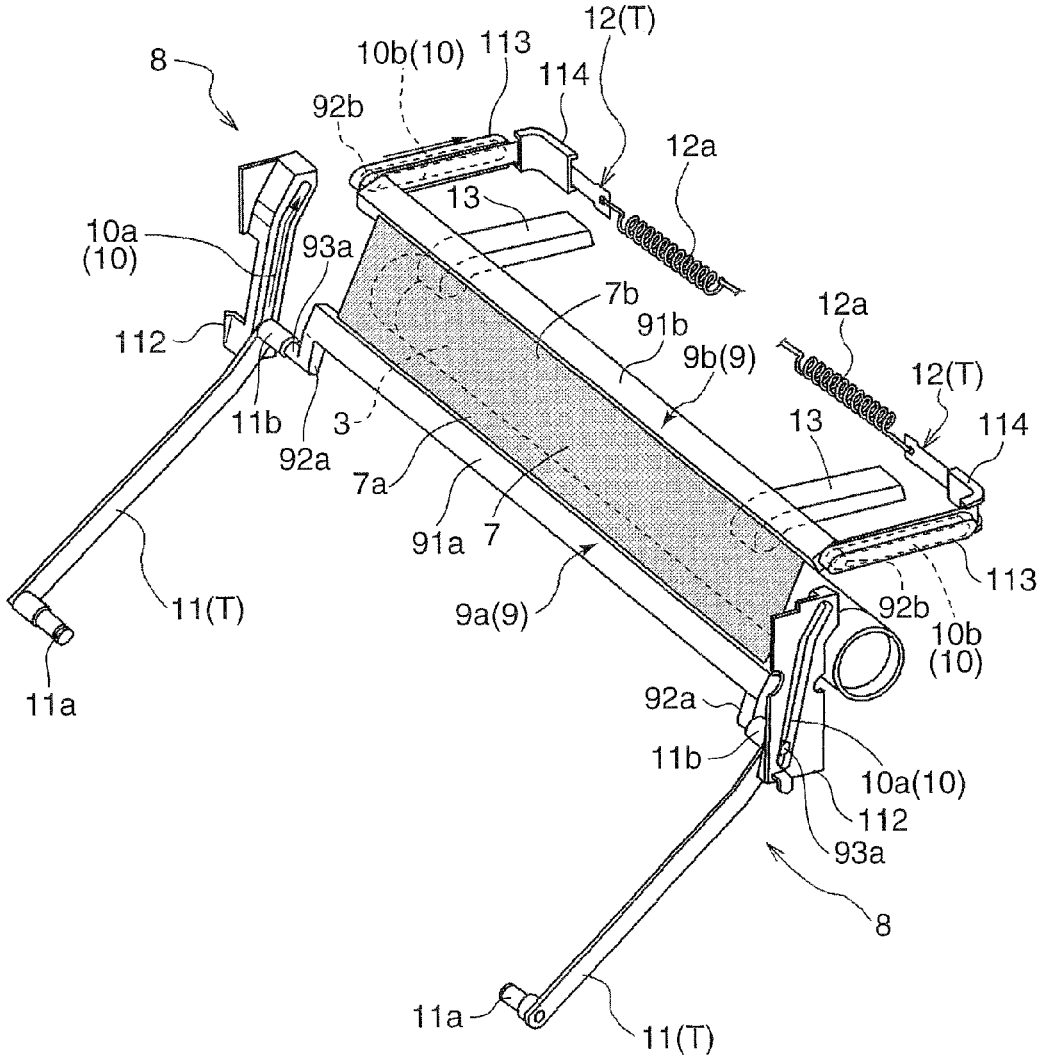
FIG. 5 is an essential perspective view showing the function of the drum cover.

In this way, when the drum cover 7 slides forward, the springs 12*a* of the strip members 12 extend, whereby the tension to the drum cover 7 can be maintained while the sliding movement of the drum cover 7 is permitted (see FIG. 5). After the opening/closing cover 6 is opened up to the finishing end, the drum cover 7 is set in the protecting state to cover the front surface of the photoconductive drum 3.

On the other hand, if the opening/closing cover 6 is closed to the closed position, contracting forces of the springs 12*a* act on the rear frame 9*b*. Since the rear frame 9*b* is pulled back by these forces, the tension to the drum cover 7 can be maintained while the sliding movement of the drum cover 7 is permitted. At this time, the first engaging portions 93*a* move upward toward the upper ends of the vertical slide guide grooves 10*a* and the second engaging portions 92*b* are guided backward in the horizontal slide guide grooves 10*b*. After the opening/closing cover 6 is completely closed, the drum cover 7 is set in the retracted state by sliding into a clearance above the photoconductive drum 3 (see FIG. 3).

A pair of left and right sheet guides 13 are arranged to extend along the lower surface of the drum cover 7 in the retracted state. The drum cover 7 sliding as the opening/closing cover 6 is opened and closed is guided along a bent path in conformity with the curves of the front ends of the sheet guides 13. Thus, even in a small clearance in the apparatus main body 1A, the drum cover 7 can be slid to reliably switch its state between the protecting state and the retracted state.

According to the image forming apparatus 1 of this embodiment, the drum cover 7 can be slidably arranged even in the small clearance in the image forming apparatus, whereby restrictions in the arrangements of the respective mechanism in the image forming apparatus can be reduced and the apparatus can be more easily downsized.

The drum cover 7 is made of a material having a high impact resistance and, in addition, the action of the tension can be maintained. Thus, even if a hand or the like touches the drum cover 7 in the protecting state upon dealing with a sheet jam, the drum cover 7 is difficult to be elastically deformed and can satisfactorily exhibit the protection function.

As a result, a degree of freedom in the arrangement of the drum cover 7 in the image forming apparatus 1 can be improved while the protection function as the drum cover 7 is satisfactorily exhibited, wherefore the image forming apparatus 1 can be downsized as a whole.

Second Embodiment

Figure 6:
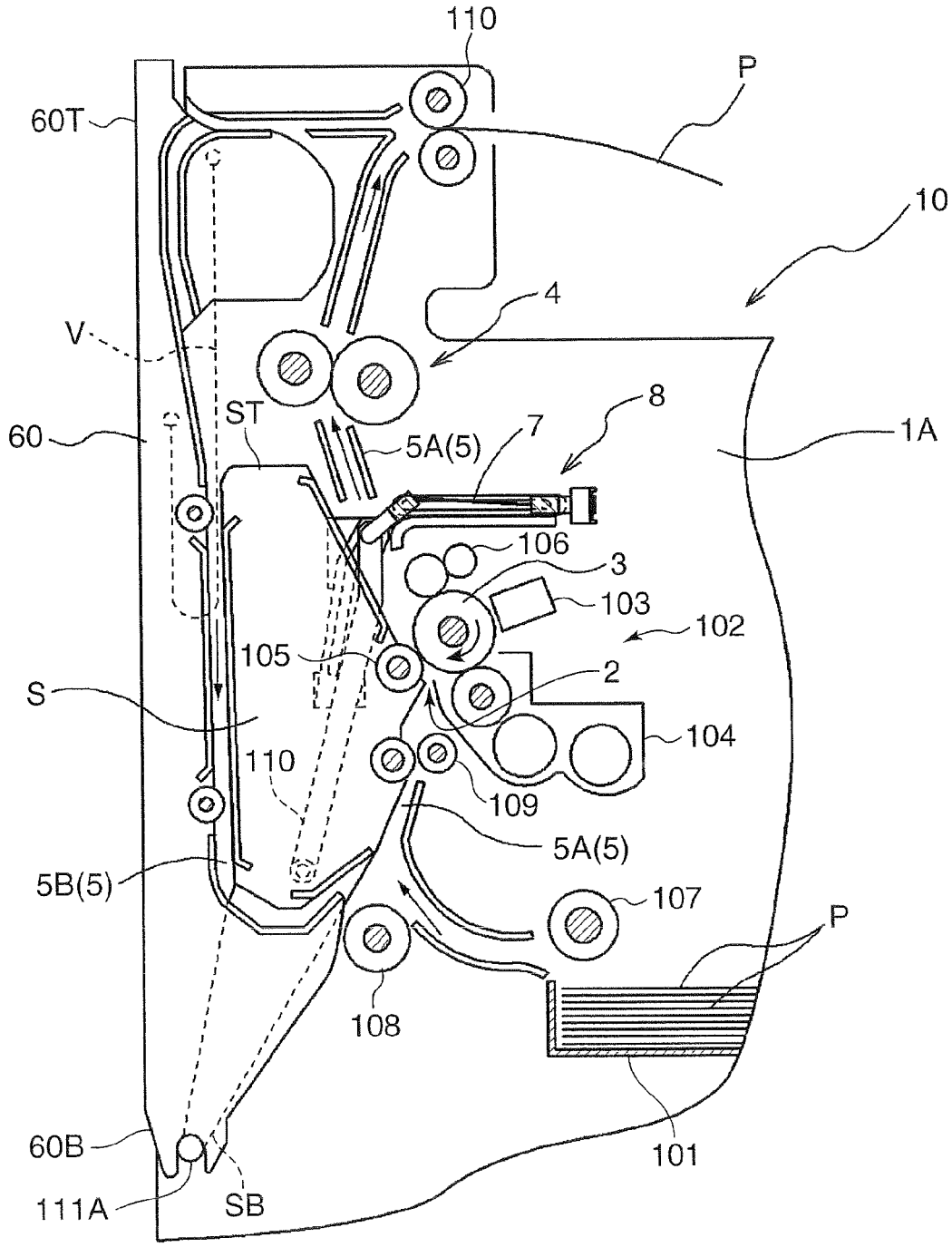
FIGS. 6, 7 are sections showing an essential portion of an image forming apparatus according to a second embodiment.
Figure 7:
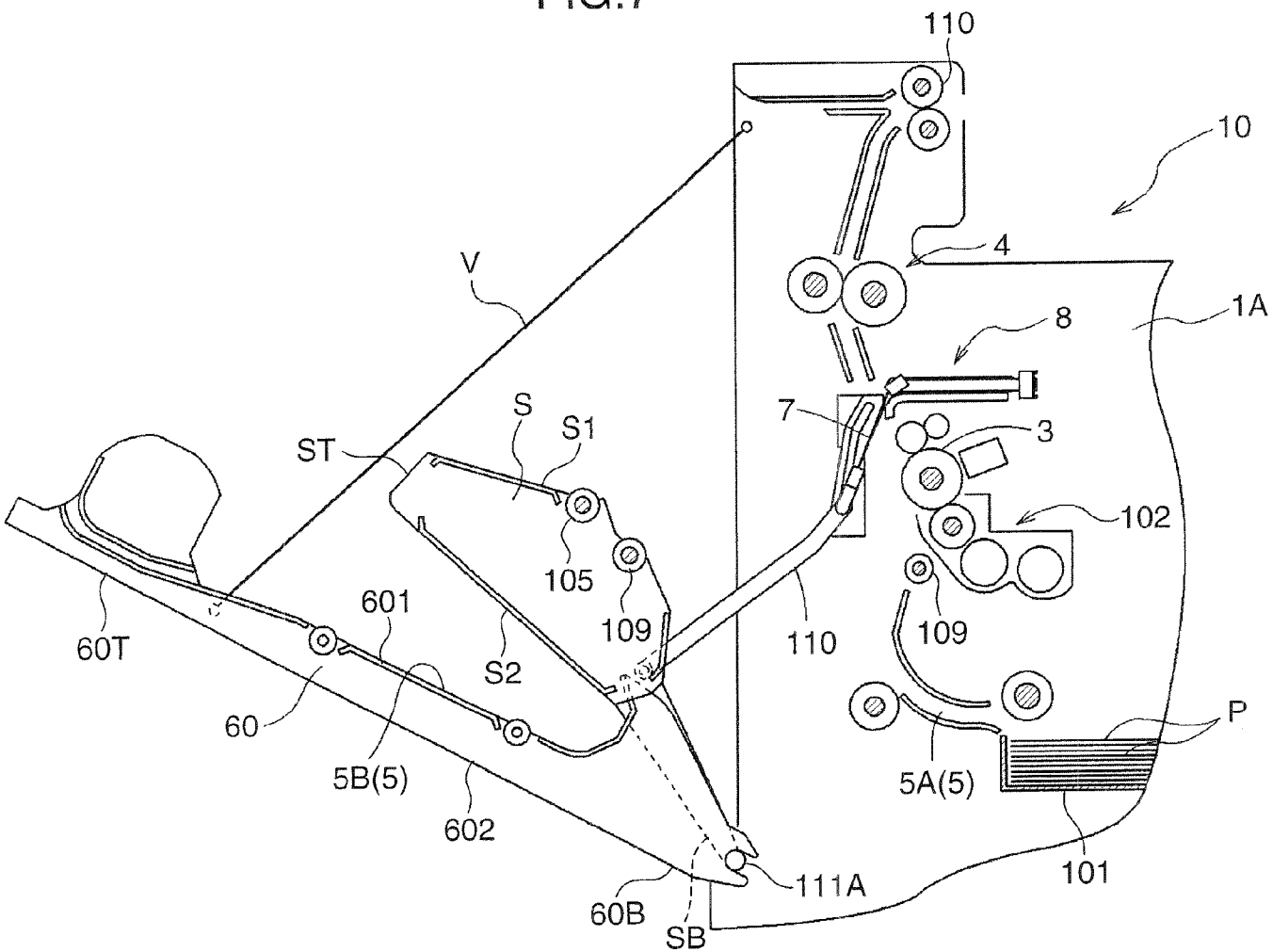

FIGS. 6 and 7 are sections showing an essential portion of an image forming apparatus 10 according to a second embodiment. This image forming apparatus 10 differs from the first embodiment in that two members, i.e. an intermediate conveying device S (opening/closing member) and an opening/closing cover 60 are so supported as to be pivotal with respect to an apparatus main body 1A. Although the image forming apparatus 10 adopts a vertical conveying method similar to the first embodiment, a conveyance path 5 differs in including a main conveyance path 5A (first conveyance path) passing an image forming assembly 102 and a reversing conveyance path (second conveyance path) for conveying a transfer material in a reverse direction at the time of duplex printing. The same parts as those of the image forming apparatus 1 of the first embodiment are identified by the same reference numerals and are either not described or briefly described.

The main conveyance path 5A is a sheet conveyance path for conveying a transfer sheet P from a sheet storage unit 101 toward discharge rollers 110 via the image forming assembly 102 and a fixing device 4. In the case of applying simplex printing to the transfer sheet P, the transfer sheet P passes only in the main conveyance path 5A. The reversing conveyance path 5B is a sheet conveyance path for conveying the transfer sheet P in a reverse direction toward an upstream side of the main conveyance path 5A at the time of duplex printing and vertically extends similar to the main conveyance path 5A.

A transfer sheet P to be printed on both sides is partly discharged by the discharge rollers 110 after an image is transferred to the top side thereof and is conveyed to the reversing conveyance path 5B by the reverse rotations of the discharge rollers 110 and the operation of an unillustrated switching guide. The transfer sheet P passes the reversing conveyance path 5B and is returned to a side of the main conveyance path 5A upstream of the arrangement position of a transfer device 2 after being turned upside down. Thereafter, the transfer sheet P passes the main conveyance path 5A and is discharged after an image is transferred to the under side thereof.

The intermediate conveying device S is arranged adjacent to the image forming assembly 102, and has a bottom end SB thereof pivotally supported by a supporting member 111A provided in the apparatus main body 1A. The intermediate conveying device S is opened (opened position: FIG. 7), for example, upon a jam processing, maintenance, inspection or the like, but is normally closed (closed position: FIG. 6). An inner side surface S1 of the intermediate conveying device S serves as one wall surface defining the main conveyance path 5A with the intermediate conveying device S held at the closed position, and an outer side surface S2 thereof serves as one wall surface defining the reversing conveyance path 5B with the intermediate conveying device S held at the closed position.

The opening/closing cover 60 is arranged outside the intermediate conveying device S and is likewise pivotally supported at its bottom end 60B by the supporting member 111A. The opening/closing cover 60 is also opened (opened position: FIG. 7), for example, upon a jam processing, maintenance, inspection or the like, but is normally closed (closed position: FIG. 6). An inner side surface 601 of the opening/closing cover 60 serves as the other wall surface defining the reversing conveyance path 5B with the opening/closing cover 60 held at the closed position, and defines the reversing conveyance path 5B together with the outer side surface S2 of the intermediate conveying device S. On the other hand, an outer side surface 602 of the opening/closing cover 60 constitutes a part of the housing of the apparatus main body 1A with the opening/closing cover 60 held at the closed position. A strip member V for supporting the opening/closing cover 60 at the opened position is mounted from the underside of an upper end 60T of the opening/closing cover 60 to a fixing portion set in the apparatus main body 1A.

The opening/closing cover 60 pivots about the supporting member 111A when being opened, whereby the upper end 60T thereof moves in a direction away from the apparatus main body 1A. The intermediate conveying device S also pivots about the supporting member 111A when being opened, whereby the upper end ST moves in a direction away from the apparatus main body 1A.

The position change of the intermediate conveying device S is linked with that of the opening/closing cover 60. The opening/closing cover 60 is so supported by the strip member V as to be held at a specified opening angle, whereas the intermediate conveying device S is supported by a pair of link arms 110 attached to a front frame 9*a* as to be held at a specified opening angle.

The respective mechanisms are set such that the opening angle of the intermediate conveying device S is smaller than that of the opening/closing cover 60. Thus, by setting the opening/closing cover 60 and the intermediate conveying device S to the opened positions, both the main conveyance path 5A and the reversing conveyance path 5B are exposed, whereby jammed sheet removal and maintenance can be more easily and quickly dealt with.

Figure 8:
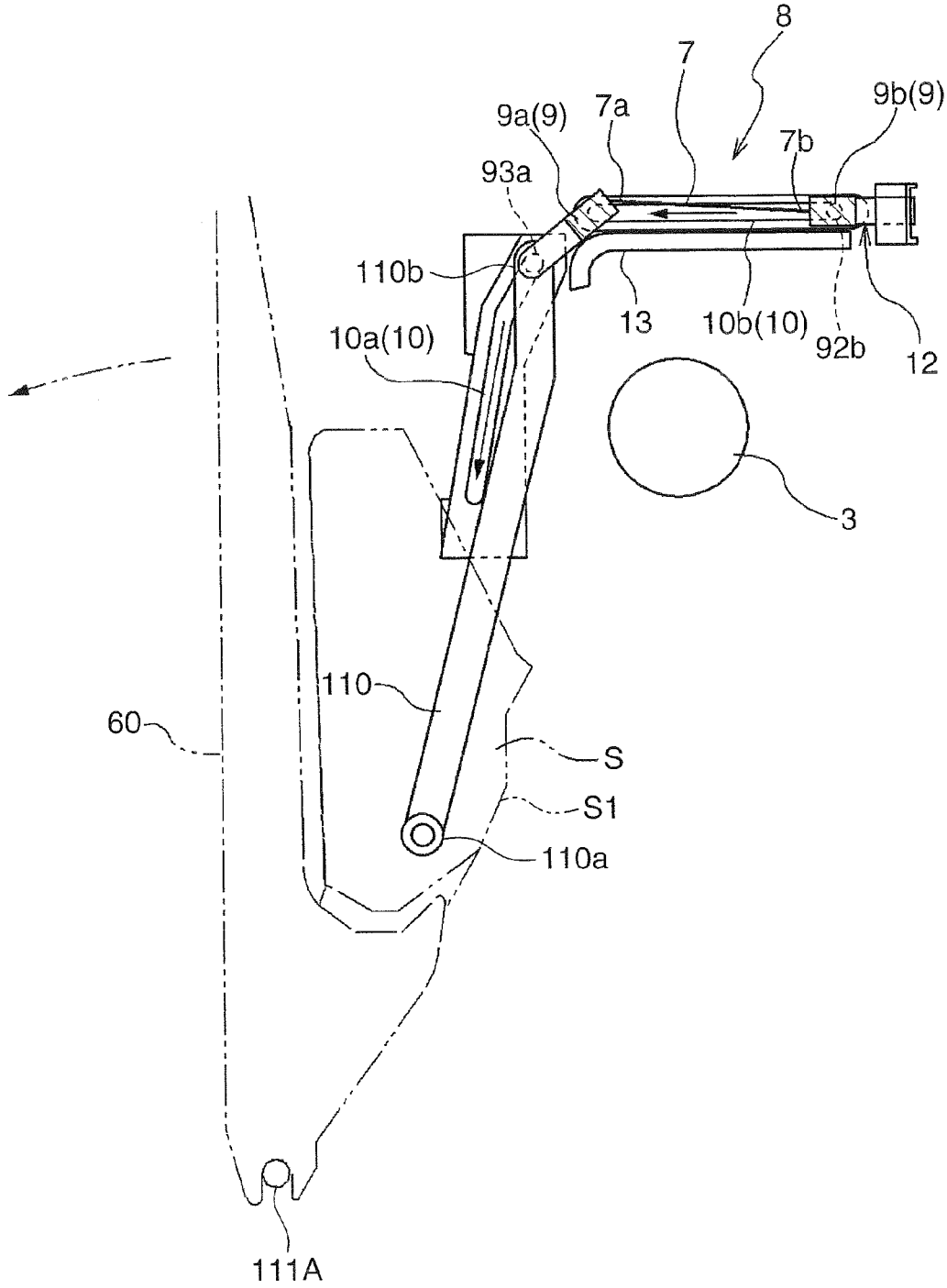
FIGS. 8 and 9 are diagrams showing the function of a drum cover according to the second embodiment when viewed in the direction of the axial center of a photoconductive drum.
Figure 9:
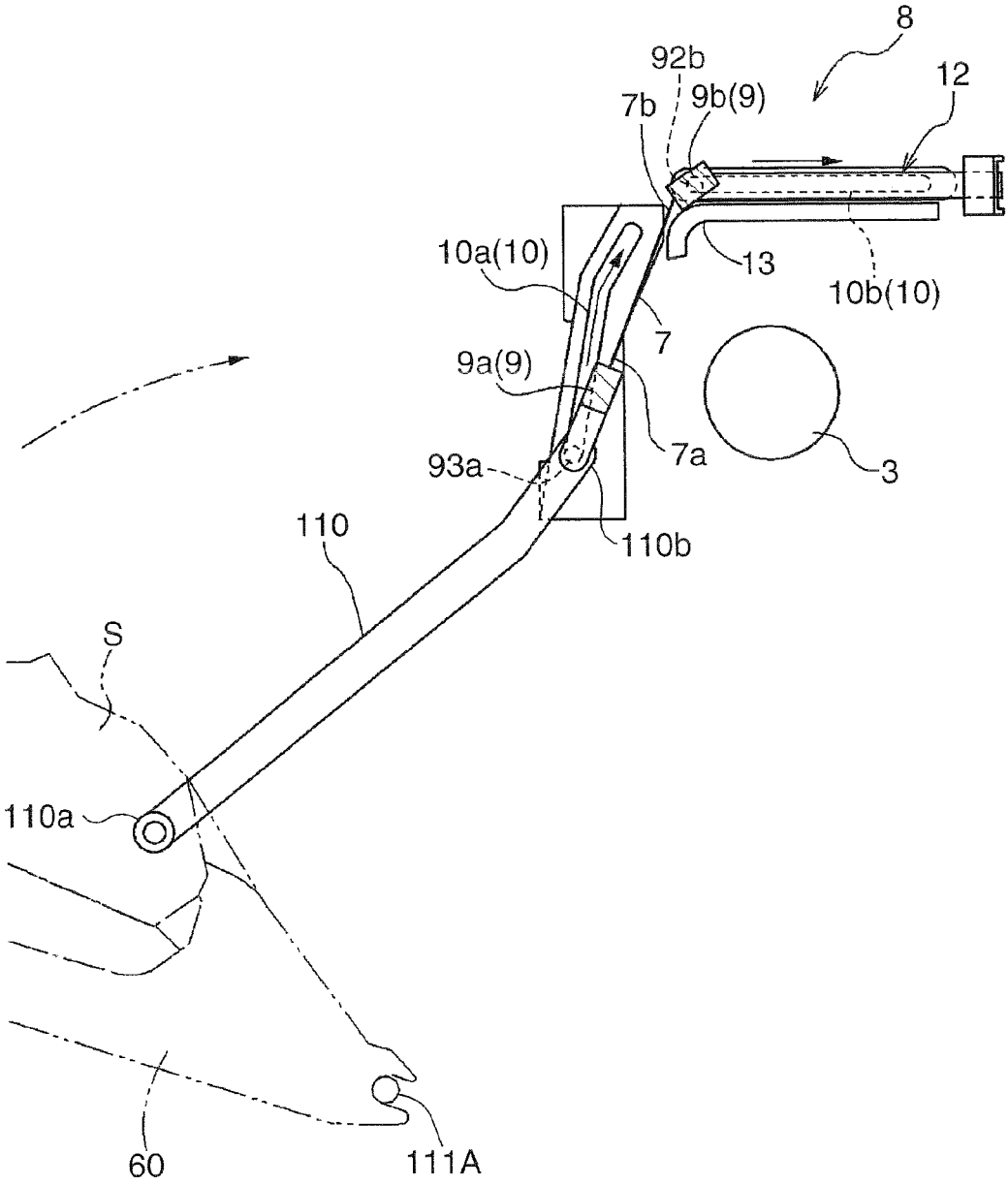

Since the constructions of a drum cover 7 and a cover moving mechanism 8 are the same as those of the first embodiment, they are not described. However, as shown in FIGS. 8 and 9, a first end 110*a* (one end) of each link arm 110 is rotatably mounted near the bottom part of the inner side surface S1 of the intermediate conveying device S. A second end 110*b* (other end) of each link arm 110 is rotatably engaged with a corresponding first engaging portion 93*a*.

The drum cover 7 and the cover moving mechanism 8 operate substantially in the same manner as in the first embodiment. When the opening/closing cover 60 is opened to the opened position, the intermediate conveying device S is accordingly shifted to the opened position. By the position change of the intermediate conveying device S, the first engaging portions 93*a* of the front frame 9*a* are pulled by the link arms 110. Accordingly, the drum cover 7 is pulled to slide in such a manner as to cover an exposed part of a photoconductive drum 3, thereby being set in a protecting state to protect the photoconductive drum 3 (see FIG. 9). On the other hand, when the opening/closing cover 60 is closed to the closed position, the intermediate conveying device S is accordingly shifted to the closed position, thereby being set in a retracted state (see FIG. 8) to be retracted from the main conveyance path 5A.

According to the image forming apparatus 10 of the second embodiment, the drum cover 7 is switched to the protecting state by the link arms 110 only through a simple operation of opening both the opening/closing cover 60 and the intermediate conveying device S, and the interior of the apparatus can be exposed with the photoconductive drum 3 protected.

Since the intermediate conveying device S is supported by the pair of link arms 110 at that time, it is more stably supported as compared to the case where it is supported only at one side.

Since the opening/closing cover 60 and the intermediate conveying device S are supported by the different supporting members and are individually supported at different opening angles, the separate conveyance paths 5A, 5B located at the opposite inner and outer sides of the intermediate conveying device S can be respectively exposed. Therefore, the removal of a jammed transfer sheet P or a maintenance operation can be easily performed for both conveyance paths 5A, 5B.

Third Embodiment

In a third embodiment are illustrated a drum cover 70, a front frame 90*a* and a rear frame 90*b* different from those of the first embodiment.

Figure 11:
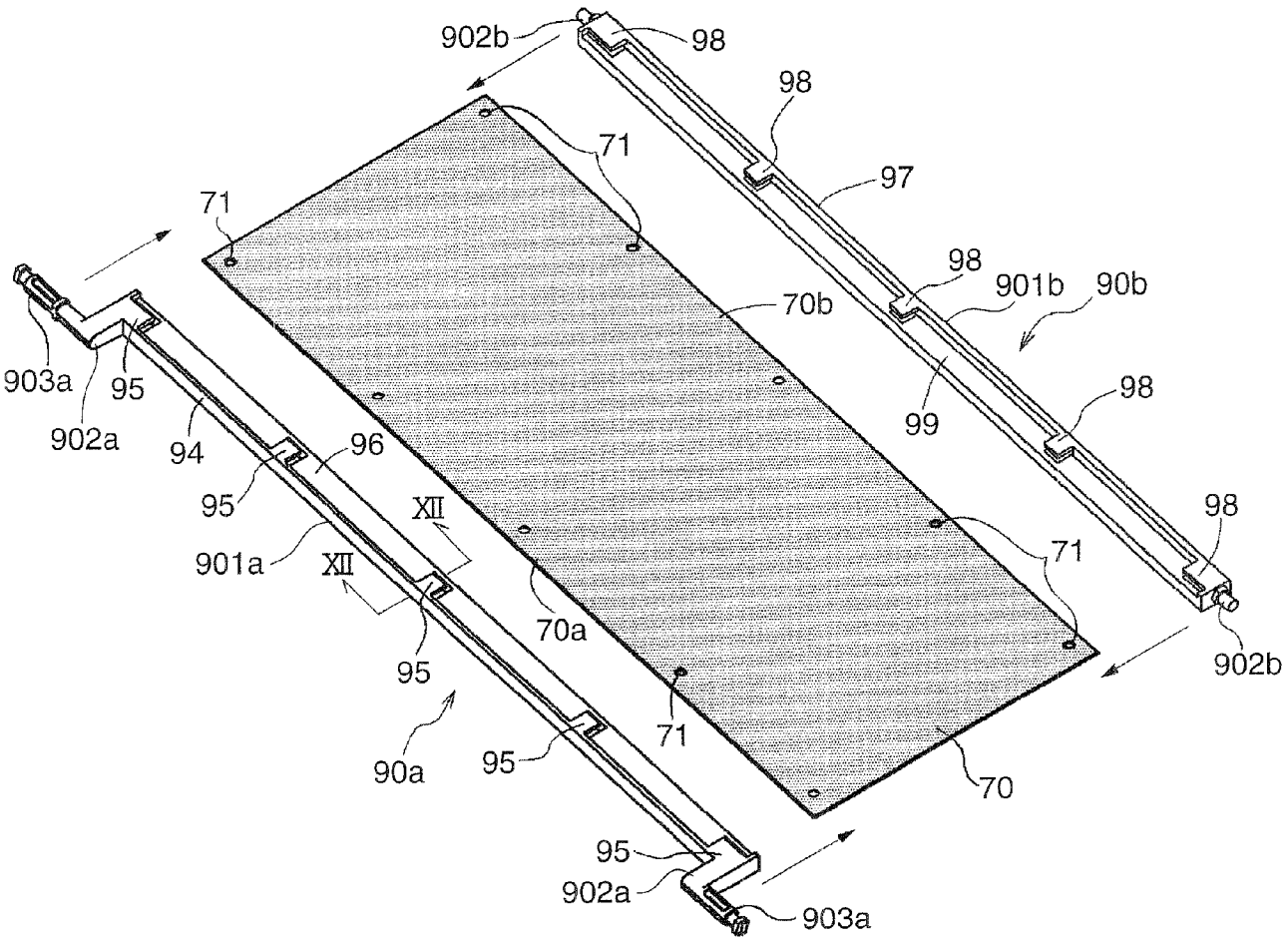
FIG. 11 is an exploded perspective view showing a drum cover, front and rear frames according to a third embodiment.

FIG. 11 is an exploded perspective view showing the drum cover 70, the front frame 90*a* and the rear frame 90*b* according to the third embodiment. The third embodiment is similar to the first embodiment in that the front frame 90*a* is attached to a front edge portion 70*a* of the drum cover 70 and the rear frame 90*b* is attached to a rear edge portion 80*b* in a sliding direction, but is characterized in attachment structures of these frames 90*a*, 90*b*.

The drum cover 70 of this embodiment is a flexible sheet-like drum cover, and a plurality of engaging holes 71, into which locking claws 951 of the front frame 90*a* and the rear frame 90*b* to be described later are fittable, are formed along width direction near the front and rear edge portions 70*a*, 70*b* thereof. The drum cover 70 is preferably made of polyethylene for the reason of being unlikely to be damaged due to its suitable elasticity even if it comes into contact with a photoconductive drum 3. Further, the thickness of the drum cover 70 is preferably 0.2 mm to 0.4 mm.

The front frame 90*a* includes a first holding portion 901*a* for holding the front edge portion 70*a* of the drum cover 70 over the entire length by sandwiching it, projecting pieces 902*a* projecting in the sliding direction from the opposite sides of the first holding portion 901*a* and first engaging portions 903*a* projecting outward from the leading ends of the respective projecting pieces 902*a* in the axial direction of the photoconductive drum 3. The rear frame 90*b* includes a second holding portion 901*b* for holding the rear edge portion 70*b* of the drum cover 70 over the entire length by sandwiching it and second engaging portions 902*b* projecting outward from the opposite sides of the second holding portion 901*b* in the axial direction of the photoconductive drum 3.

The first holding portion 901*a* of the front frame 90*a* includes a base portion 94, first wall portions 95 and a second wall portion 96. The second holding portion 901*b* of the rear frame 90*b* similarly includes a base portion 97, first wall portions 98 and a second wall portion 99. Since the first and second holding portions 901*a*, 901*b* are substantially identically constructed, only the front frame 90*a* is described below.

Figure 12:
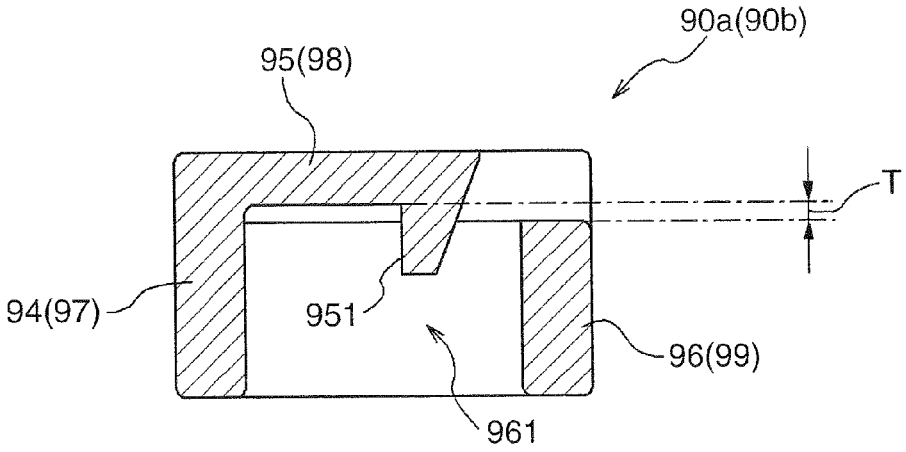
FIG. 12 is a section along XII-XII of FIG. 11.
Figure 13:
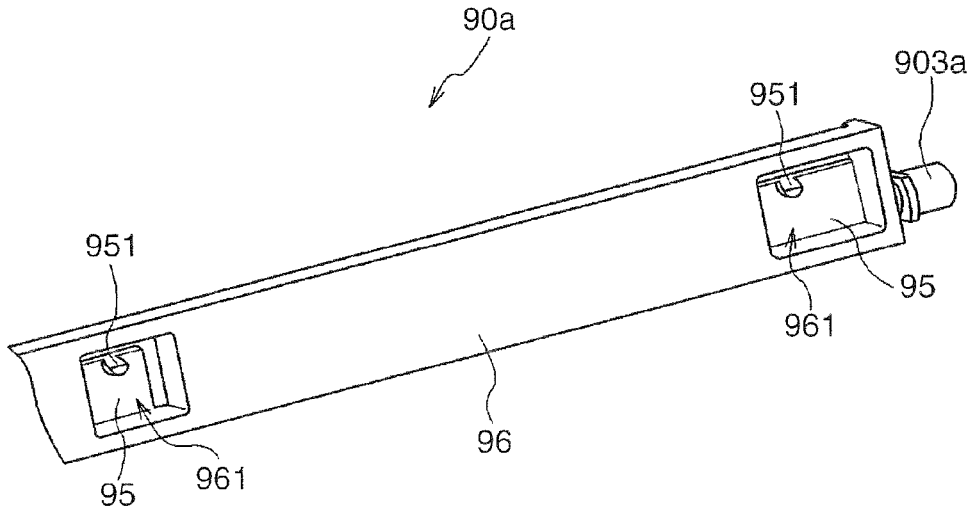
FIG. 13 is a partial perspective view of the front (rear) frame.

FIG. 12 is a section along XII-XII of FIG. 11, and FIG. 13 is a partial perspective view of the front frame 90*a* (rear frame 90*b*). The first and second wall portions 95, 96 stand up from the base portion 94 in such a manner as to face each other while being spaced apart by a specified distance (T). The second wall portion 96 is a wall standing substantially over the entire length of the base portion 94, whereas the first wall portions 95 are partial walls standing at a plurality of positions in the longitudinal direction of the base portion 2.

Each of the first wall portions 95 is provided with the locking claw 951 fittable into the engaging hole 71 formed near the front edge portion 70*a* (rear edge portion 70*b*) of the drum cover 70. Accommodation recesses 961 capable of accommodating at least the leading ends of the locking claws 951 are formed at positions of the second wall portion 96 facing the locking claws 951 of the respective first wall portions 95.

It is sufficient for the accommodation recesses 961 to be shaped such that the front edge portion 70*a* of the drum cover 70 is insertable and at least the leading ends of the locking claws 951 can be accommodated. In this embodiment, as shown in FIG. 13, the accommodation recesses 961 are in the form of openings penetrating the second wall portion 96. Thus, an operator can easily confirm the fitted states of the locking claws 951 of the first wall portions 95 in the engaging holes 71 of the drum cover 70 (whether or not the locking claws 951 are correctly fitted in the engaging holes 71 of the drum cover 70) through these openings.

Upon attaching the front frame 90*a* and the rear frame 90*b* to the drum cover 70, the respective engaging holes 71 of the drum cover 70 and the respective first wall portions 95, 98 of the front frame 90*a* and the rear frame 90*b* are positioned as shown in FIG. 11. Then, the front edge portion 70*a* of the drum cover 70 is inserted between the first and second wall portions 95, 96 of the front frame 90*a* and the rear edge portion 70*b* is inserted between the first and second wall portions 98, 99 of the rear frame 90*b*.

Figure 14A:
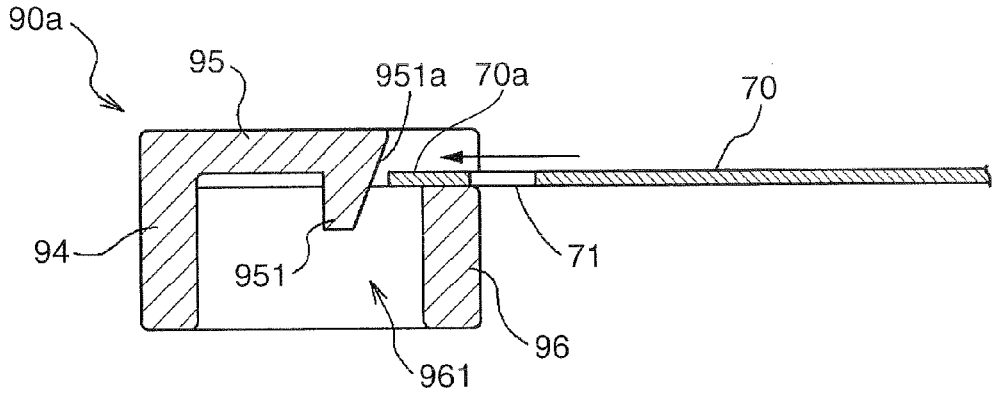
FIGS. 14A to 14C are sections showing a locked state of an end of the drum cover.
Figure 14B:
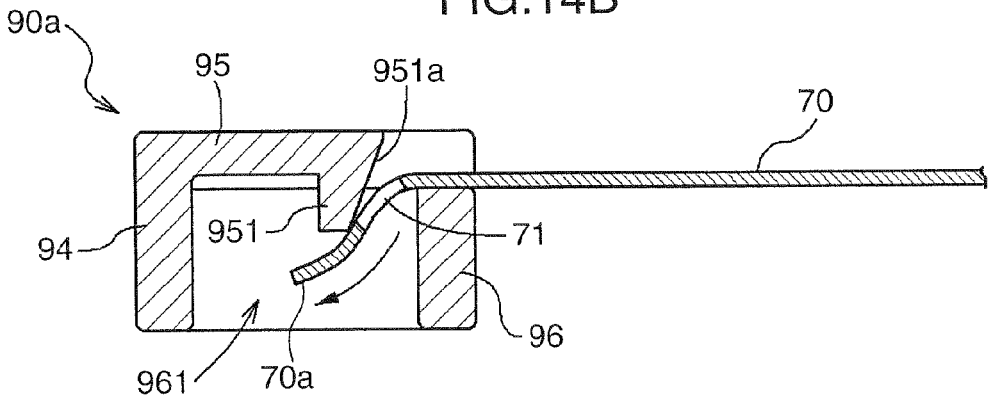
Figure 14C:
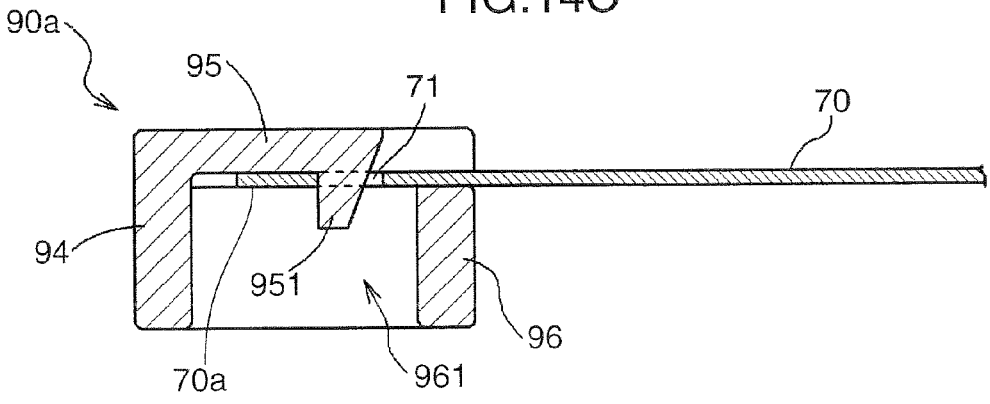

FIGS. 14A to 14C are sections showing a state of engaging the front edge portion 70*a* of the drum cover 70 with the front frame 90*a*. The front edge portion 70*a* of the drum cover 70 is inserted between the locking claws 951 of the first wall portions 95 and the accommodation recesses 961 of the second wall portion 96 (see FIG. 14A). Then, the front edge portion 70*a* comes into contact with slanted surfaces 951*a* of the locking claws 951 to be guided downward along the slanted surfaces 951*a*, thereby heading for the cavities of the accommodation recesses 961. Upon moving over the slanted surfaces 951*a* (see FIG. 14B), the respective locking claws 951 are fitted into and engaged with the corresponding engaging holes 71 of the drum cover 70 (see FIG. 14C), thereby completing the attachment.

The specified distance (T) between the first wall portions 95 and the second wall portion 96 is preferably set such that the locking claws 951 of the first wall portion 95 are fitted into and engaged with the engaging holes 71 of the drum cover 70 and the front edge portion 70*a* is horizontally kept with the lower surface of the front edge portion 70*a* of the drum cover 70 held in contact with the upper surface of the second wall portion 96 as shown in FIG. 14C.

Figure 15:
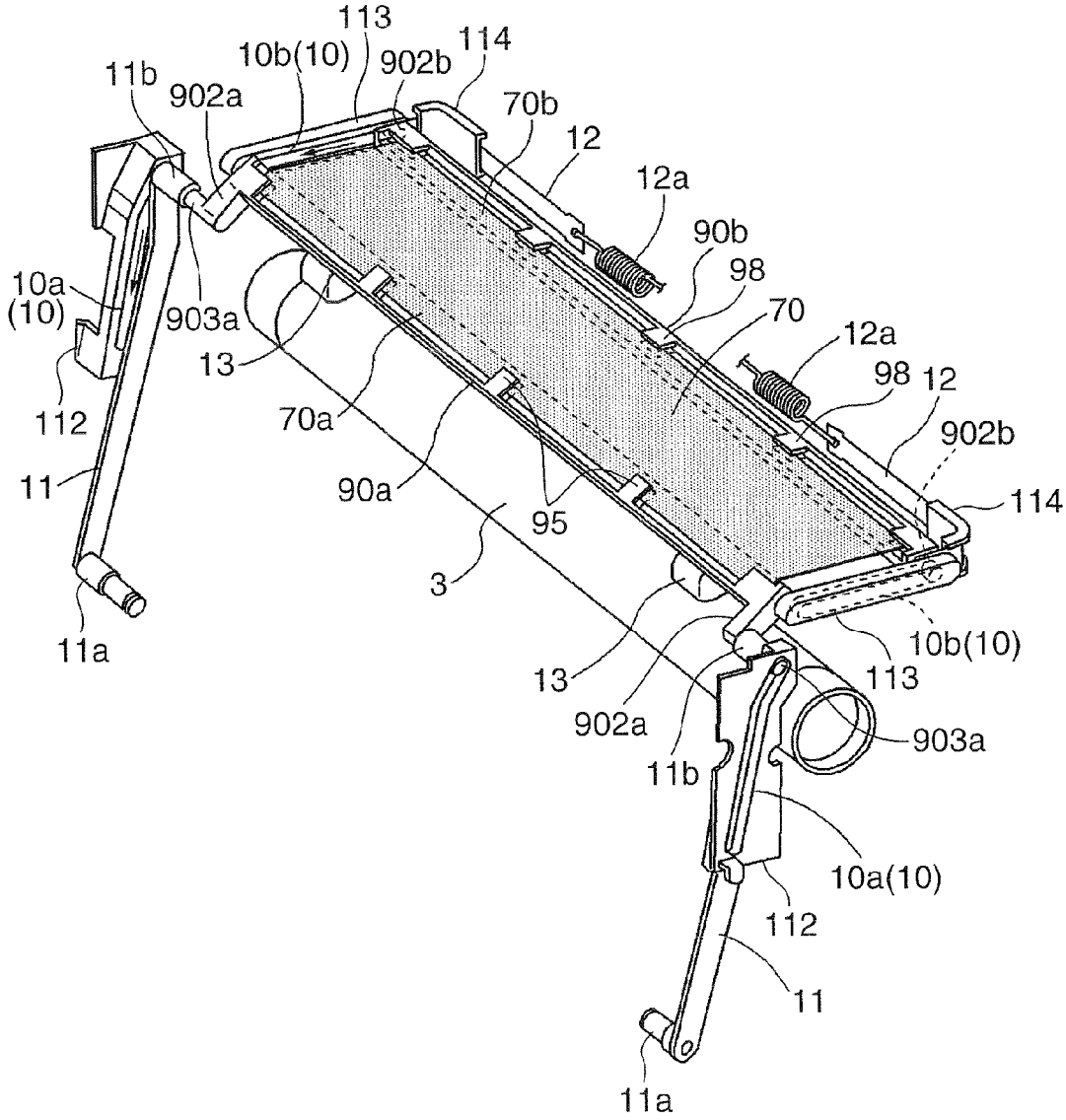
FIGS. 15 and 16 are essential perspective views showing the function of the drum cover according to the third embodiment.
Figure 16:
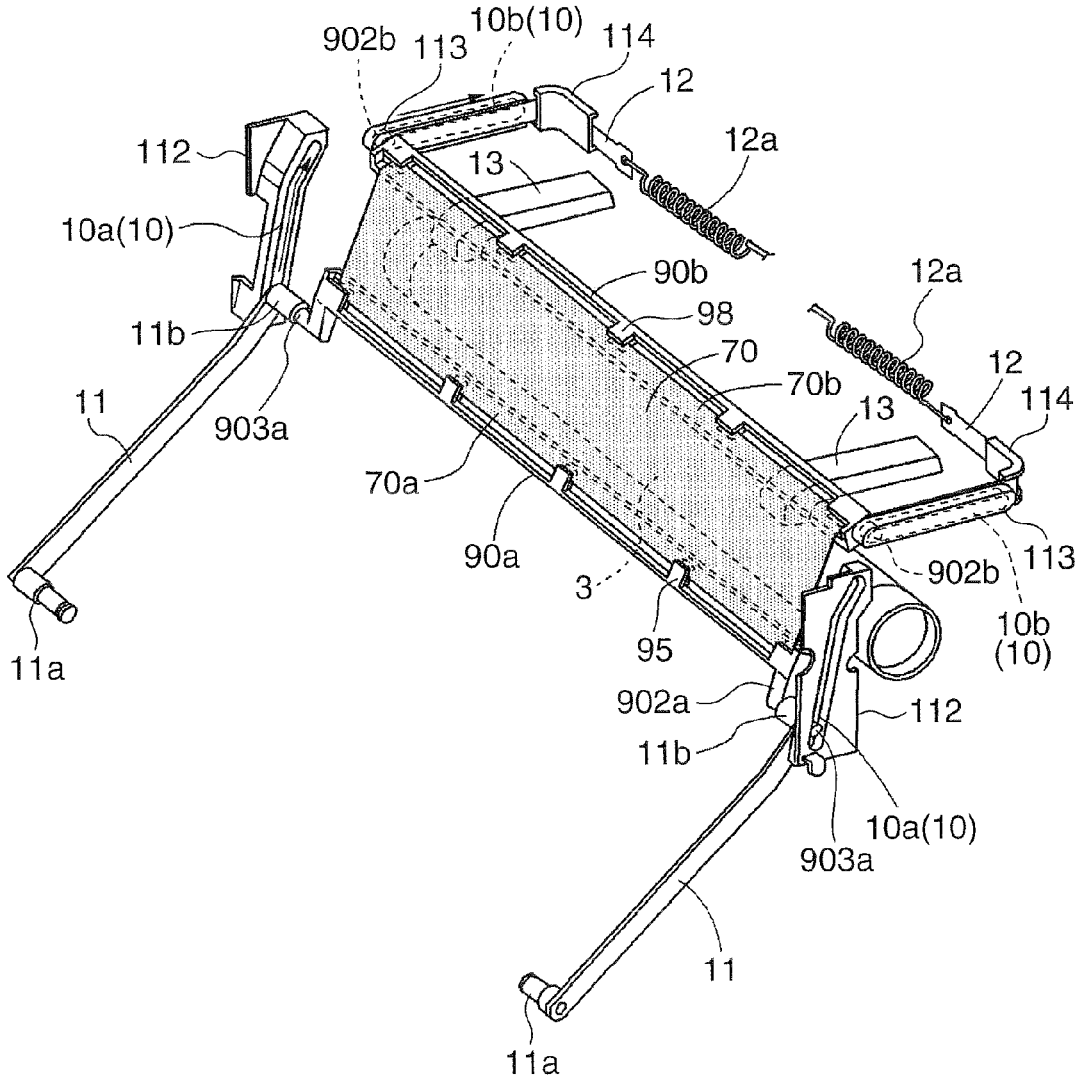
Figure 17:
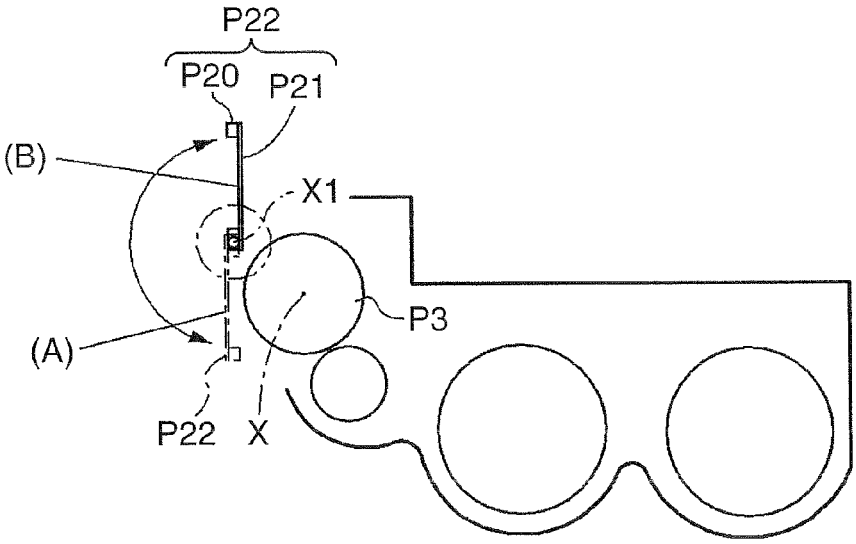
PRIOR ART FIG.17
FIG. 17 is a diagram showing a conventional drum cover.
Figure 18:
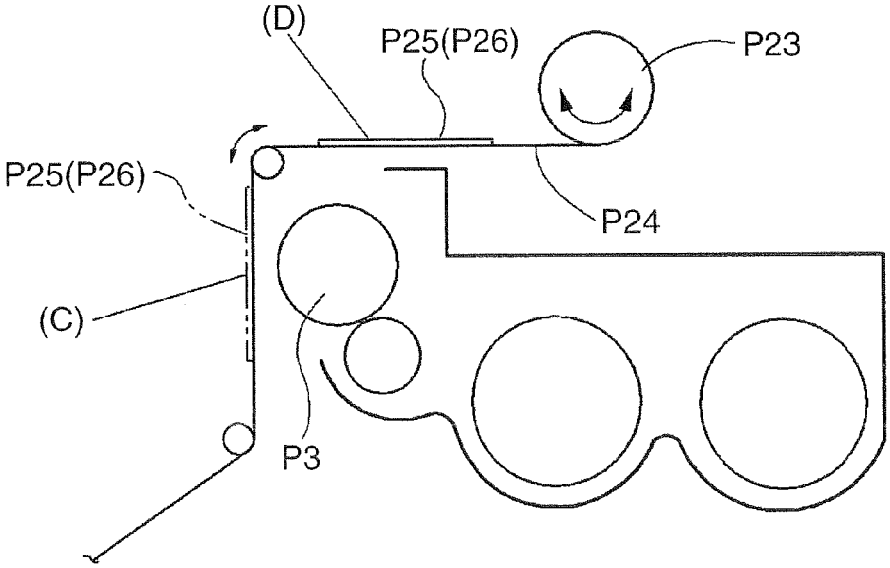
PRIOR ART FIG.18
FIG. 18 is a diagram showing another conventional drum cover.

FIGS. 15 and 16 are essential perspective views showing the function of the drum cover 70 according to the third embodiment, wherein FIG. 15 shows a retracted state of the drum cover 70 and FIG. 16 shows a protecting state where the front surface of the photoconductive drum 3 is covered by the drum cover 70. The assembly construction and operation of the drum cover 70 are similar to the construction previously described with reference to FIGS. 3 and 5 except for the supported mode of the drum cover 70 by the front frame 90*a* and the rear frame 90*b*.

Description of Other Modifications

The three embodiments of the present invention are described above, but the present invention is not limited to these. For example, the following modifications may be made.

The constructions of the image forming apparatuses 1, 10 are not limited to those described in the previous embodiments, and other known apparatus constructions may be adopted. Further, although the image forming apparatuses 1, 10 adopt the so-called "vertical conveying method" in the above examples, another conveying method may be adopted. In short, any suitable conveying method can be adopted provided that a drum cover is used.

(2) The drum cover made of polyethylene is used in the above embodiments. Without limiting the material of the drum cover to this, another synthetic resin sheet (e.g. polystyrene sheet, polyester sheet, polypropylene sheet, etc.) or fabric, paper or metal sheet (e.g. aluminum sheet, stainless steel sheet, etc.) may be, for example, used.

(3) The slide guide portions 10 are not limited to grooves and may be, for example, rails. Further, each slide guide portion 10 may include a guide changing member capable of changing the shape and position of the guiding path, so that the sliding path of the drum cover can be suitably changed. As a result, even in the case of, for example, a recording sheet jam at a position where it is difficult to remove the jammed recording sheet, the position and posture of the drum cover can be changed to those where the jammed sheet can be easily removed if the positions of the slide guide portions 10 are changed by the guide changing members, wherefore a jam processing and a maintenance operation can be more efficiency performed.

Figure 10:
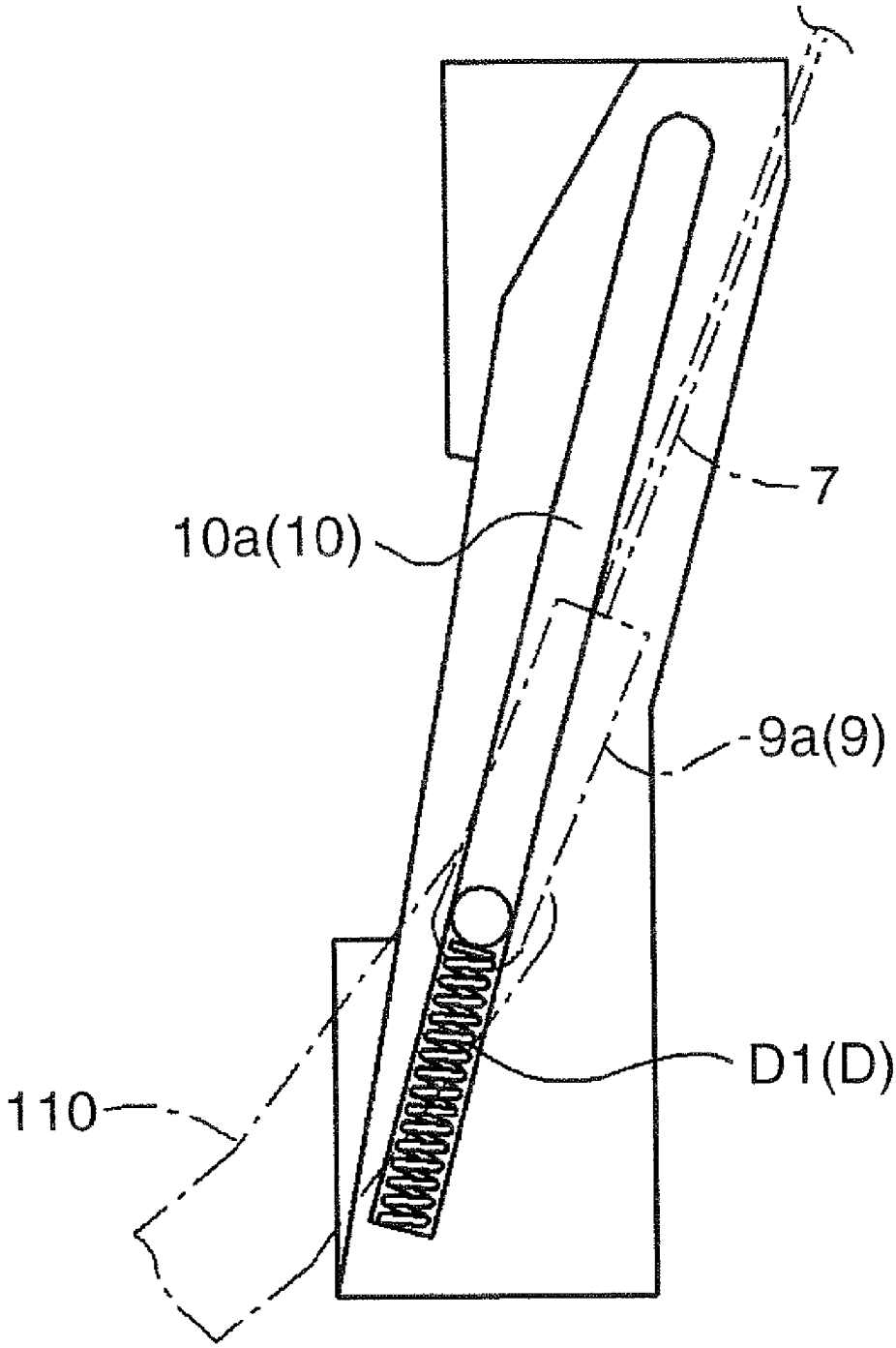
FIG. 10 is a diagram showing a damper mechanism.

(4) The mechanisms for moving the drum covers 7, 70 are not limited to those described in the above embodiments. For example, a damper mechanism D may be provided to exert a resistance force during a movement from the retracted state to the protecting state. FIG. 10 shows an example of the damper mechanism D. A spring D1 is arranged in the slide guide groove 10 as the damper mechanism D to exert a resistance force when the fitted part of the front frame 9*a* slides. Of course, the damper mechanism D may be other than the spring, e.g. a damper taking advantage of frictional resistance.

(5) In the above embodiments, the photoconductive drum 3 is illustrated as the image bearing member. Besides, the present invention is also applicable for the protection of an intermediate transfer belt, to which toner images of the respective colors are transferred in a superimposed manner in a color image forming apparatus.

The specific embodiments described above mainly embrace inventions having the following constructions.

An image forming apparatus according to one aspect of the present invention comprises an apparatus main body having a housing structure; a conveyance path provided in the apparatus main body for conveying a transfer material, to which an image is to be transferred; an opening/closing member attached to the apparatus main body and displaceable between a closed position and an opened position where the conveyance path is exposed; an image bearing member arranged in the apparatus main body to face the conveyance path and adapted to bear the image to be transferred to the transfer material; an image bearing member cover having such a size as to cover the image bearing member, made of a flexible sheet material, set in a protecting state to cover a part of the image bearing member facing the conveyance path when the opening/closing member is at the opened position and set in a retracted state to be retracted from the conveyance path when the opening/closing member is at the closed position; a cover moving mechanism for sliding the image bearing member cover between the protecting state and the retracted state; a front frame and a rear frame movably held by the cover moving mechanism and respectively attached to front and rear edge portions of the image bearing member cover in a sliding direction; and a tension applying mechanism for applying a tension acting in the sliding direction to the image bearing member cover via the front and rear frames during a sliding movement of the image bearing member cover.

According to this construction, the image bearing member cover is made of the flexible sheet material. Thus, even if a sliding path for the image bearing member cover by the cover moving mechanism is set to be bent, the image bearing member cover can be slid along this sliding path. Therefore, the sliding path for the image bearing member cover can be set even in a small clearance in the image forming apparatus, thereby reducing restrictions in the arrangements of the respective mechanisms in the image forming apparatus and making it easier to downsize the apparatus.

Further, the state where the tension acts on the image bearing member cover can be maintained by the tension applying mechanism. Thus, even if hand or the like should touch the image bearing member cover in the protecting state upon dealing with a sheet jam, the image bearing member cover is unlikely to be bent and the protecting state can be satisfactorily exhibited.

In the above construction, the front and rear frames are preferably so attached as to hold the front and rear edge portions of the image bearing member cover substantially entirely.

According to this construction, the tension acting in the sliding direction and applied by the tension applying mechanism can be distributed over the entire width of the image bearing member cover, wherefore the image bearing member cover can be moved while being stretched in such a manner as not to be creased. Hence, it becomes possible to move and accommodate the image bearing member cover even in a smaller clearance without getting caught.

In the above construction, it is preferable that the front frame includes a first holding portion for holding the front edge portion of the image bearing member cover and first engaging portions projecting outward at the opposite sides of the first holding portion; that the rear frame includes a second holding portion for holding the rear edge portion of the image bearing member cover and second engaging portions projecting outward at the opposite sides of the second holding portion; and that the cover moving mechanism includes slide guide portions engageable with and guiding the first and second engaging portions in the sliding direction.

According to this construction, the front and rear frames and the image bearing member cover can be moved along the sliding direction set by the slide guide portions. Thus, it becomes possible to set the path, in which the image bearing member cover is passed and accommodated without interfering with the respective mechanisms, even in a very small clearance or space in the image forming apparatus, wherefore the entire apparatus can be downsized. Further, since the moving path for the image bearing member cover can be freely and accurately set (e.g. vertical arrangement, horizontal arrangement, oblique arrangement, curved arrangement, etc.) so that other things are more unlikely to touch the image bearing member, a protection effect and a light shielding effect for the image bearing member can be further improved.

In the above construction, it is preferable that each slide guide portion includes a first guide portion engageable with the corresponding first engaging portion and a second guide portion engageable with the corresponding second engaging portion; and that the first guide portions vertically extend and the second guide portions horizontally extend.

According to this construction, the L-shaped sliding path for the image bearing member cover when viewed sideways can be set around the image bearing member, and the apparatus can be more easily downsized.

In the above construction, the tension applying mechanism preferably includes a first arm member having one end thereof attached to the opening/closing member and the other end thereof attached to the front frame and a second arm member assembled with an elastic member and having one end thereof attached to the rear frame and the other end thereof attached to a specified fixing portion of the apparatus main body via the elastic member.

According to this construction, the tension applying mechanism can be constructed by a very simple mechanism and a cost increase resulting from a functional improvement can be maximally reduced.

For example, in such a case where the frame includes an end stopper for preventing a movement of the opening/closing member in an opening direction at its finishing end, the finishing end position of the opening/closing member can be defined by this end stopper. Even in such a case, a situation sometimes occur in which hand is released from the opening/closing member being opened and the opening/closing member opens with force due to its own weight. In order to stop such a sudden movement in the opening direction, a large impact force is generated. On the other hand, since the other end of the first arm member having the one end thereof attached to the opening/closing member is attached to the front frame in the above construction, most of the impact force is transmitted from the opening/closing member to the front frame via the first arm member only by providing the end stopper in such a manner as to act on the front frame. The impact force is hardly transmitted to the image bearing member cover, the rear frame and a strip member fitted with the elastic member arranged after the front frame in the transmission path of the impact force, wherefore loads can be reduced. As a result, the breakage of the image bearing member cover can be prevented and the protection function for the image bearing member can be maintained.

In the above construction, the conveyance path is preferably a vertical conveyance path for vertically conveying the transfer material.

In an image forming apparatus adopting a vertical conveying method, the image bearing member is frequently exposed when the opening/closing member is set to the opened position. Therefore, the present invention can be suitably applied.

In this case, a supporting member arranged in the apparatus main body for pivotally supporting the opening/closing member may be further provided; the opening/closing member may be an opening/closing cover having the bottom end thereof pivotally supported about the supporting member; and the opening/closing cover may have an inner side surface and an outer side surface, the inner side surface serving as one wall surface defining the conveyance path with the opening/closing cover held at the closed position and the outer side surface constituting a part of the covering of the apparatus main body with the opening/closing cover held at the closed position.

Alternatively, a supporting member arranged in the apparatus main body for pivotally supporting the opening/closing member may be further provided; the conveyance path may include a first conveyance path for image formation and a second conveyance path for conveying the transfer material in a reverse direction at the time of duplex printing; the opening/closing member may include an intermediate conveying device having the bottom end thereof pivotally supported about the supporting member; and the intermediate conveying device may have an inner side surface and an outer side surface, the inner side surface serving as one wall surface defining the first conveyance path with the intermediate conveying device held at the closed position and the outer side surface serving as one wall surface defining the second conveyance path with the intermediate conveying device held at the closed position.

In this case, an opening/closing cover having the bottom end thereof pivotally supported about the supporting member and displaceable between an opened position and a closed position may be further provided; the opening/closing cover may have an inner side surface and an outer side surface, the inner side surface serving as the other wall surface defining the second conveyance path with the opening/closing cover held at the closed position and the outer side surface constituting a part of the covering of the apparatus main body with the opening/closing cover held at the closed position; and the position change of the intermediate conveying device may be linked with that of the opening/closing cover.

According to this construction, the intermediate conveying device is opened and the image bearing member cover is slid to be switched to the protecting state only by opening the opening/closing cover, wherefore the interior of the apparatus can be exposed with the image bearing member protected.

In the above construction, it is preferable that engaging holes are formed near the front and rear edge portions of the image bearing member cover; that each of the front and rear frame includes a first wall portion and a second wall portion facing each other while being spaced apart by a specified distance, locking claws provided on the first wall portion and fittable into the engaging holes of the image bearing member cover and accommodation recesses formed at positions of the second wall portion facing the locking claws and capable of accommodating at least the leading ends of the locking claws; and that the front and rear edge portions of the image bearing member cover are inserted between the locking claws of the first wall portion and the accommodation recesses of the second wall portion and the locking claws are fitted into the engaging holes to be engaged with the front and rear frames.

According to this construction, the image bearing member cover can be easily and quickly attached to the front and rear frames and it is not necessary to use adhesive. Further, since the image bearing member cover having the engaging holes engaged with the locking claws are located between the first and second wall portions facing each other, even if the locking claws try to come out of the engaging holes, such movements are prevented by the second wall portion, wherefore the image bearing member cover can be securely kept attached without being easily detached.

In this case, the accommodation recesses are preferably openings penetrating the second wall portion.

According to this construction, the fitted state of the locking claws of the first wall portions in the engaging holes of the image bearing member cover (whether or not the locking claws have been correctly fitted into the image bearing member cover) can be easily confirmed through the openings of the second wall portion.

In the above construction, it is preferable to further comprise a damper mechanism for applying a resistance force to at least one sliding movement of the front and rear frames when the state of the image bearing member cover changes from the retracted state to the protecting state.

According to this construction, the action of the damper mechanism influences not only the operation of the image bearing member cover, but also the operation of the opening/closing member moving together with the image bearing member cover, wherefore impact can be absorbed upon opening the opening/closing member. Thus, even if the opening/closing member is somewhat roughly opened, the breakdown of the opening/closing member can be easily prevented, thereby being able to improve the durability of the image forming apparatus.

In the above construction, the image bearing member is preferably a photoconductive drum.

An image forming apparatus according to another aspect of the present invention comprises an apparatus main body having a housing structure; a conveyance path provided in the apparatus main body for conveying a transfer material, to which an image is to be transferred; an image bearing member for bearing the image to be transferred to the transfer material; an image bearing member cover having such a size as to cover the image bearing member, made of a flexible sheet material and capable of changing the state thereof between a protecting state to cover a part of the image bearing member facing the conveyance path and a retracted state to be retracted from the conveyance path; a cover moving mechanism for sliding the image bearing member cover between the protecting state and the retracted state; a front frame and a rear frame movably held by the cover moving mechanism and attached to a front edge portion and a rear edge portion of the image bearing member cover in a sliding direction; and a tension applying mechanism for applying a tension acting in the sliding direction to the image bearing member cover via the front and rear frames during a sliding movement of the image bearing member cover, wherein engaging holes are formed near the front and rear edge portions of the image bearing member cover; each of the front and rear frames includes a first wall portion and a second wall portion facing each other while being spaced apart by a specified distance, locking claws provided on the first wall portion and fittable into the engaging holes of the image bearing member cover, and accommodation recesses formed at positions of the second wall portion facing the locking claws and capable of accommodating at least the leading ends of the locking claws; and the front and rear edge portions of the image bearing member cover are inserted between the locking claws of the first wall portions and the accommodation recesses of the second wall portions to be engaged with the front and rear frames by fitting the locking claws into the engaging holes.

This application is based on patent application Nos. 2007-077302, 2007-102802 and 2007-155398 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus, comprising:

an apparatus main body having a housing structure;

a conveyance path provided in the apparatus main body for conveying a transfer material, to which an image is to be transferred;

an opening/closing member attached to the apparatus main body and displaceable between a closed position and an opened position where the conveyance path is exposed;

an image bearing member arranged in the apparatus main body to face the conveyance path and adapted to bear the image to be transferred to the transfer material;

an image bearing member cover having such a size as to cover the image bearing member, made of a flexible sheet material, set in a protecting state to cover a part of the image bearing member facing the conveyance path when the opening/closing member is at the opened position and set in a retracted state to be retracted from the conveyance path when the opening/closing member is at the closed position;

a cover moving mechanism for sliding the image bearing member cover between the protecting state and the retracted state;

a front frame and a rear frame movably held by the cover moving mechanism and respectively attached to front and rear edge portions of the image bearing member cover in a sliding direction; and a tension applying mechanism for applying a tension acting in the sliding direction to the image bearing member cover via the front and rear frames during a sliding movement of the image bearing member cover, wherein the cover moving mechanism includes a first guide portion vertically extending on a side facing the conveyance path of the image bearing member, and a second guide portion horizontally extending above the image bearing member, and the front frame is vertically guided by the first guide portion, and the rear frame is horizontally guided by the second guide portion, whereby the cover moving mechanism retracts the image bearing member cover above the image bearing member when the image bearing member cover is in the retracted state, and slides the image bearing member cover so as to cover the image bearing member on the side facing the conveyance path of the image bearing member when the image bearing member cover is in the protecting state.

2. An image forming apparatus according to claim 1, wherein the front and rear frames are so attached as to hold the front and rear edge portions of the image bearing member cover substantially entirely.

3. An image forming apparatus according to claim 2, wherein:

the front frame includes a first holding portion for holding the front edge portion of the image bearing member cover and first engaging portions projecting outward at the opposite sides of the first holding portion;

the rear frame includes a second holding portion for holding the rear edge portion of the image bearing member cover and second engaging portions projecting outward at the opposite sides of the second holding portion;

the first guide portion is a vertically extending first guide groove engagable with the first engaging portion and allowing a vertical sliding movement of the first engaging portion, and the second guide portion is a horizontally extending second guide groove engagable with the second engaging portion and allowing a horizontal sliding movement of the second engaging portion.

4. An image forming apparatus according to claim 1, wherein the tension applying mechanism includes:

a first arm member having one end thereof attached to the opening/closing member and the other end thereof attached to the front frame, and a second arm member assembled with an elastic member and having one end thereof attached to the rear frame and the other end thereof attached to a specified fixing portion of the apparatus main body via the elastic member.

5. An image forming apparatus according to claim 1, wherein the conveyance path is a vertical conveyance path for vertically conveying the transfer material.

6. An image forming apparatus according to claim 5, further comprising a supporting member arranged in the apparatus main body for pivotally supporting the opening/closing member, wherein:

the opening/closing member is an opening/closing cover having the bottom end thereof pivotally supported about the supporting member; and the opening/closing cover has an inner side surface and an outer side surface, the inner side surface serving as one wall surface defining the conveyance path with the opening/closing cover held at the closed position and the outer side surface constituting a part of the covering of the apparatus main body with the opening/closing cover held at the closed position.

7. An image forming apparatus according to claim 5, further comprising a supporting member arranged in the apparatus main body for pivotally supporting the opening/closing member, wherein:

the conveyance path includes a first conveyance path for image formation and a second conveyance path for conveying the transfer material in a reverse direction at the time of duplex printing;

the opening/closing member includes an intermediate conveying device having the bottom end thereof pivotally supported about the supporting member; and the intermediate conveying device has an inner side surface and an outer side surface, the inner side surface serving as one wall surface defining the first conveyance path with the intermediate conveying device held at the closed position and the outer side surface serving as one wall surface defining the second conveyance path with the intermediate conveying device held at the closed position.

8. An image forming apparatus according to claim 7, wherein the opening/closing member further includes an opening/closing cover having the bottom end thereof pivotally supported about the supporting member and displaceable between an opened position and a closed position, wherein:

the opening/closing cover has an inner side surface and an outer side surface, the inner side surface serving as the other wall surface defining the second conveyance path with the opening/closing cover held at the closed position and the outer side surface constituting a part of a covering of the apparatus main body with the opening/closing cover held at the closed position; and the position change of the intermediate conveying device is linked with that of the opening/closing cover.

9. An image forming apparatus according to claim 1, wherein:

engaging holes are formed near the front and rear edge portions of the image bearing member cover;

each of the front and rear frame includes a first wall portion and a second wall portion facing each other while being spaced apart by a specified distance, locking claws provided on the first wall portion and fittable into the engaging holes of the image bearing member cover and accommodation recesses formed at positions of the second wall portion facing the locking claws and capable of accommodating at least leading ends of the locking claws; and the front and rear edge portions of the image bearing member cover are inserted between the locking claws of the first wall portion and the accommodation recesses of the second wall portion and the locking claws are fitted into the engaging holes to be engaged with the front and rear frames.

10. An image forming apparatus according to claim 9, wherein the accommodation recesses are openings penetrating the second wall portion.

11. The image forming apparatus according to claim 9, wherein the locking claw includes a slanted surface for guiding the front edge portion of the image bearing member cover or the rear edge portion of the image bearing member cover toward a cavity of the accommodation recess when the front edge portion of the image bearing member cover or the rear edge portion of the image bearing member cover is inserted between the locking claw of the first wall portion and the accommodation recess of the second wall portion.

12. An image forming apparatus according to claim 1, further comprising a damper mechanism for applying a resistance force to at least one sliding movement of the front and rear frames when the state of the image bearing member cover changes from the retracted state to the protecting state.

13. An image forming apparatus according to claim 1, wherein the image bearing member is a photoconductive drum.

14. An image forming apparatus, comprising:

an apparatus main body having a housing structure;

a conveyance path provided in the apparatus main body for conveying a transfer material, to which an image is to be transferred;

an image bearing member for bearing the image to be transferred to the transfer material;

an image bearing member cover having such a size as to cover the image bearing member, made of a flexible sheet material and capable of changing the state thereof between a protecting state where a part of the image bearing member facing the conveyance path is protected and a retracted state to be retracted from the conveyance path;

a cover moving mechanism for sliding the image bearing member cover between the protecting state and the retracted state, the cover moving mechanism including a first guide portion vertically extending on a side facing the conveyance path of the image bearing member, and a second guide portion horizontally extending above the image bearing member;

a front frame and a rear frame movably held by the cover moving mechanism and attached to a front edge portion and a rear edge portion of the image bearing member cover in a sliding direction, the front frame being vertically guided by the first guide portion, and the rear frame being horizontally guided by the second guide portion, whereby the cover moving mechanism retracts the image bearing member cover above the image bearing member when the image bearing member cover is in the retracted state, and slides the image bearing member cover so as to cover the image bearing member on the side facing the conveyance path of the image bearing member when the image bearing member cover is in the protecting state; and a tension applying mechanism for applying a tension acting in the sliding direction to the image bearing member cover via the front and rear frames during a sliding movement of the image bearing member cover, wherein:

engaging holes are formed near the front and rear edge portions of the image bearing member cover;

each of the front and rear frames includes a first wall portion and a second wall portion facing each other while being spaced apart by a specified distance, locking claws provided on the first wall portion and fittable into the engaging holes of the image bearing member cover, and accommodation recesses formed at positions of the second wall portion facing the locking claws and capable of accommodating at least the leading ends of the locking claws; and the front and rear edge portions of the image bearing member cover are inserted between the locking claws of the first wall portions and the accommodation recesses of the second wall portions to be engaged with the front and rear frames by fitting the locking claws into the engaging holes.

15. An image forming apparatus, comprising:

an apparatus main body having a housing structure;

a vertical conveyance path provided in the apparatus main body for vertically conveying a transfer material, to which an image is to be transferred;

an opening/closing member attached to the apparatus main body and displaceable between a closed position and an opened position where the conveyance path is exposed;

an image bearing member arranged in the apparatus main body to face the conveyance path and adapted to bear the image to be transferred to the transfer material;

an image bearing member cover having such a size as to cover the image bearing member, made of a flexible sheet material, set in a protecting state to cover a part of the image bearing member facing the conveyance path when the opening/closing member is at the opened position and set in a retracted state to be retracted from the conveyance path when the opening/closing member is at the closed position;

a cover moving mechanism for sliding the image bearing member cover between the protecting state and the retracted state;

a front frame and a rear frame movably held by the cover moving mechanism and respectively attached to front and rear edge portions of the image bearing member cover in a sliding direction;

a tension applying mechanism for applying a tension acting in the sliding direction to the image bearing member cover via the front and rear frames during a sliding movement of the image bearing cover; and a supporting member arranged in the apparatus main body for pivotally supporting the opening/closing member, wherein:

the conveyance path includes a first conveyance path for image formation and a second conveyance path for conveying the transfer material in a reverse direction at the time of duplex printing, the opening/closing member includes an intermediate conveying device having the bottom end thereof pivotally supported about the supporting member, and the intermediate conveying device has an inner side surface and an outer side surface, the inner side surface serving as one wall surface defining the first conveyance path with the intermediate conveying device held at the closed position, and the outer side surface serving as one wall surface defining the second conveyance path with the intermediate conveying device held at the closed position.

16. The image forming apparatus according to claim 15, further comprising:

an opening/closing cover having the bottom end thereof pivotally supported about the supporting member and displaceable between the opened position and the closed position, wherein:

the opening/closing cover has an inner side surface and an outer side surface, the inner side surface serving as the other wall surface defining the second conveyance path with the opening/closing cover held at the closed position, the outer side surface constituting a part of a covering of the apparatus main body with the opening/closing cover held at the closed position, and the position change of the intermediate conveying device is linked with that of the opening/closing cover.

* * * * *